US007699760B2

(12) United States Patent
Hruska, Jr.

(10) Patent No.: US 7,699,760 B2
(45) Date of Patent: Apr. 20, 2010

(54) PHYSICAL THERAPY SYSTEM

(76) Inventor: Ronald J. Hruska, Jr., 8831 Avon La., Lincoln, NE (US) 68505

( * ) Notice: Subject to any disclaimer, the term of this patent is extended or adjusted under 35 U.S.C. 154(b) by 28 days.

(21) Appl. No.: 11/651,653

(22) Filed: Jan. 10, 2007

(65) Prior Publication Data

US 2007/0184947 A1 Aug. 9, 2007

Related U.S. Application Data

(60) Provisional application No. 60/757,822, filed on Jan. 10, 2006.

(51) Int. Cl.
*A63B 21/008* (2006.01)
*A61H 9/00* (2006.01)
*A47K 33/00* (2006.01)

(52) U.S. Cl. ..... 482/111; 4/541.3; 601/157

(58) Field of Classification Search ..... 482/111–112; 4/904, 541.3–541.6, 509; 601/157
See application file for complete search history.

(56) References Cited

U.S. PATENT DOCUMENTS 3,534,413 A * 10/1970 Plasseraud ..... 4/492
4,825,854 A * 5/1989 Henkin et al. ..... 601/157
4,853,987 A * 8/1989 Jaworski ..... 4/541.6
4,934,689 A 6/1990 Burdenko
4,941,217 A 7/1990 Tobias et al.
4,948,118 A 8/1990 Miraglia
5,018,723 A 5/1991 Burdenko
5,290,210 A 3/1994 Hand et al.
5,295,929 A * 3/1994 Weisz ..... 482/54
5,328,423 A 7/1994 Abboudi et al.
5,819,333 A 10/1998 Coleman
5,913,754 A 6/1999 Lochbaum
5,921,892 A 7/1999 Easton
2004/0225237 A1 11/2004 Keren
2005/0159275 A1 7/2005 Bullman et al.

* cited by examiner

*Primary Examiner*—Steve R Crow
(74) *Attorney, Agent, or Firm*—Vincent L. Carney

(57) ABSTRACT

To reposition parts of the body, pool therapy fixtures are used in a pool to develop neuromuscular recognition of the normal human musculoskeletal, respiratory and neurological patterns with feed forward activation. Individual muscles are isolated using the buoyancy of the pool, and in some cases applying streams of water within the pool against specific muscles. Selected forces may be applied using water jets in multiple directions in a programmed sequence with at least one pool therapy fixture to provide neuromuscular training.

16 Claims, 13 Drawing Sheets

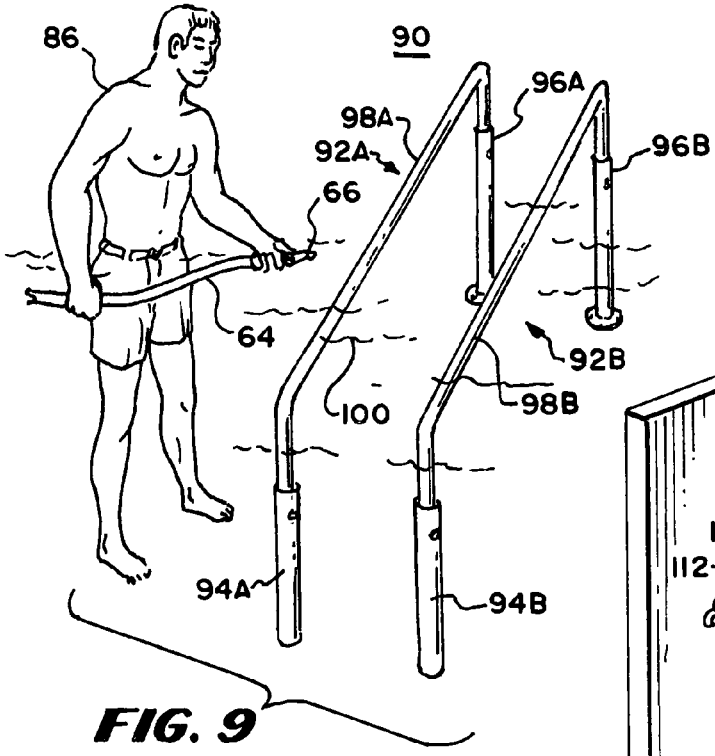
FIG. 9
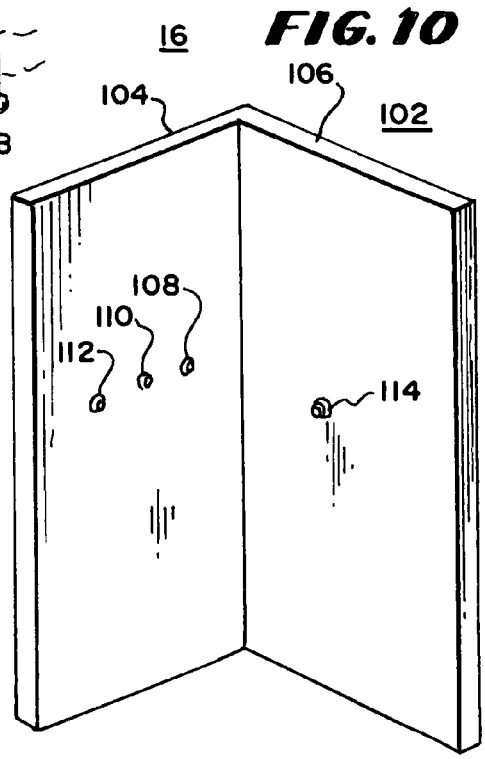
FIG. 10
FIG. 11
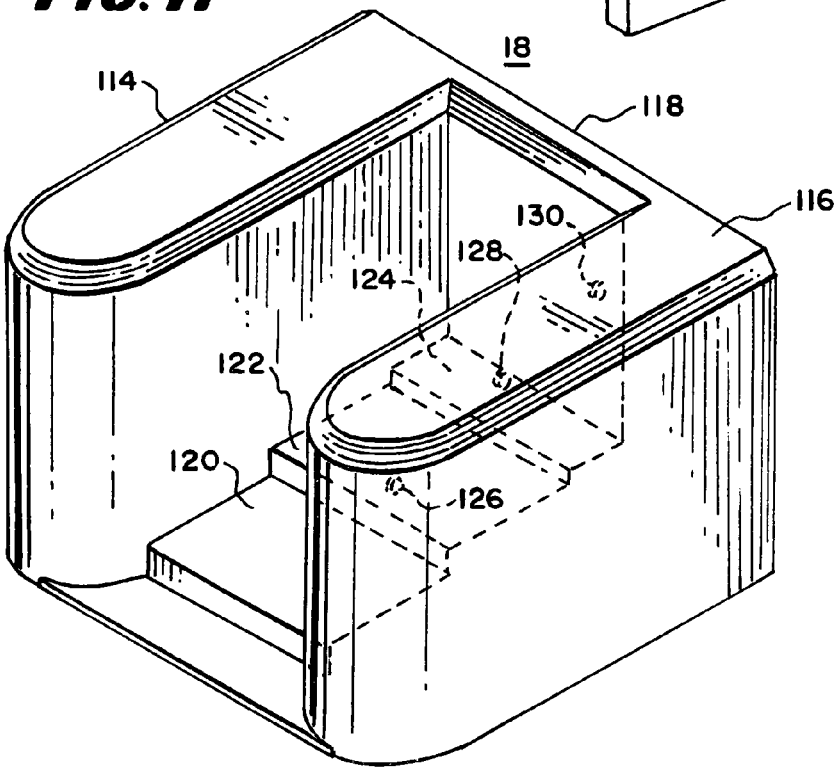

PHYSICAL THERAPY SYSTEM

RELATED CASES

This application is a continuation-in-part application of U.S. provisional patent application 60/757,822 filed Jan. 10, 2006, by inventor, Ronald J. Hruska, Jr. The benefit of provisional patent application 60/757,822 is claimed.

BACKGROUND OF THE INVENTION

This invention relates to physical therapy techniques and equipment.

Physical therapy systems are known that provide controlled resistance to the motion of selected muscles. The motion against the controlled resistance is intended to provide neuromuscular training of the body that results in better positioning of body parts, particularly during motion. In one prior art system of this type, a brace is used to control the resistance to motion of a particular muscle. This approach works well but has the disadvantage of lacking versatility in its application. In most applications, it operates in only one plane on one muscle rather than in all three dimensions and on more than one muscle if desired. Moreover, it is not readily adaptable to different persons and different muscles but is generally tailored for use on a single limb by a single person.

It is also known to provide controlled exercise against the flow of water in a pool of water that provides reduced weight conditions. In one such prior art system disclosed in U.S. Pat. Nos. 5,662,558; 5,367,719 and 5,005,228, patients exercise in a pool and may exercise against the flow of water. Individual work stations that provide both open and closed chain exercise are included. This system has a disadvantage in that the individual muscles are not adequately isolated or inhibited.

SUMMARY OF THE INVENTION

Accordingly, it is an object of the invention to provide a novel therapy system.

It is a further object of the invention to provide a novel neuromuscular repositioning system.

It is a still further object of the invention to provide a novel method and apparatus for isolating and exercising selected muscles in a controlled sequence to obtain neuromuscular training of the body.

It is a still further object of the invention to provide a novel method and apparatus of applying fluid pressure at selected points for exercising.

It is a still further object of the invention to provide a novel physical therapy training method and a novel apparatus for exercising with controlled motion in multiple dimensions.

It is a still further object of the invention to provide a novel exercise pool having at least one work station in which water is applied in selected directions and/or in a selected sequence and/or against selected body portions.

It is a still further object of the invention to provide a novel exercise pool.

It is a still further object of the invention to provide a novel neuromuscular training apparatus and method that is independent of visual stimuli.

It is a still further object of the invention to provide neuromuscular training apparatuses and methods that reduce the time needed from therapists and related personnel to achieve the desired neuromuscular results.

In accordance with the above and further objects of the invention, novel physical therapy apparatuses and methods are provided that develop a neuromuscular recognition of the normal human musculoskeletal, respiratory, and neurological patterns. These novel apparatuses and methods reduce undesirable patterns of neural motor tone created by gravitational forces and normal human biomechanical asymmetric function. The novel physical therapy system may be used for targeting of muscles to reduce compensatory muscle association with neuro-mechanical patterns of movement.

In using the novel apparatuses and methods, a patient's body parts are repositioned within a therapy pool using pool therapy fixtures that cause the patient to reposition the body parts in the desired position in response to the pool therapy fixtures and thus to train the neuromuscular system to normally position the body parts to the desired position. In this specification the words, "pool therapy fixture" mean any device or apparatus that cooperates with the water in the pool to reposition the body part of a patient from an undesirable position to a more desirable position. The faulty body position is diagnosed using conventional well-known techniques and is not part of this invention. Usually during treatment in accordance with this invention, individual muscles are isolated and caused to assume a desired position with pressure that inhibits some muscles and/or enhances the action of other muscles to provide neuromuscular training. The physical therapist diagnoses muscles that have developed over time to compensate for the normal asymmetries of the body and overuse of some muscles in normal activities on dry land. Muscles are isolated in the pool by the natural buoyancy of the body and the compensatory muscles developed on dry land are reduced and other muscles repositioned to their correct positions and strengthened using feed forward exercises to provide neuromuscular training in multiple dimensions. A common pool therapy fixture is a nozzle that forces a current or stream of water against a selected body part of a patient.

In an embodiment of the invention in which the pool therapy fixtures include nozzles through which water is pumped against selected body parts, movement of the patient and placement of the nozzles is used to redirect the body parts to the correct orientation vector individually. The amount of force applied to the patient is adjustable according to the pressure setting for each nozzle. This combination allows for a highly variable system that can be used universally for any target audience (i.e. geriatrics, pediatrics, athletics, etc.) by easy adjustment for each individual. Embodiments of pool therapy fixtures that rely on fluidic forces such as pumped water that apply adjustable and limited force are sometimes referred to in this specification as "fluidic pool therapy fixtures".

In other embodiments of the invention not relying on fluidic forces, the patient is caused to reposition his or her body parts by the combination of buoyancy in the water and exercise. For example, in one exercise, the patient stands in the center of a loop of rope that has a preset resistance to motion, grips the section of the rope to his or her right with his or her right hand and grips the section of rope to his or her left with his or her left hand and pulls with one hand or the other against the resistance to movement. Because of the patient's buoyancy, the patient's cervical curvature, thoracic curvature and lumbar curvature are repositioned from improper positions that may have been assumed over time to their proper position. In other examples, the patient performs standard exercises referred to in the field as ski shift, retro walking or side walking, press downs, step overs and step arounds using submerged parallel bars and submersible block.

In fluidic pool therapy fixtures, the patient moves against fluidic forces while fluidic forces are applied at angles to different muscles. The patient moves against the force of the fluid first on one side or in one direction and then on another side or in another direction. In a preferred embodiment, a pool is provided and the exercises are performed under reduced weight conditions in the pool. One preferred embodiment of the invention is a station within a pool where there are two circular cross sections adjacent to each other with water flowing clockwise in one section and counterclockwise in the other section. The patient moves in a figure eight pattern cycling between the two sections by moving first through the loop of the station against the clockwise flow of water and then through the other loop against the counterclockwise water flow. In the first loop, nozzles apply force to the patient at an angle to one side of the body at locations and in the second loop nozzles apply force to the opposite side of the patient's body at different locations. The nozzles are at preselected but different elevations. The resulting effect is that the patient is obtaining controlled three-dimensional exercise with some individual muscle isolation.

In some embodiments of the invention, individual stations within a pool may be used to elicit the sequential movement response by the patient and some pools may include more stations or fewer stations than the preferred embodiment, which uses nine stations. Moreover, different combinations of stations other than the specific combination of nine stations in the preferred embodiment may be used. All nine stations in the preferred embodiment provide neuromuscular isolation with feed forward activation. Stations one through four provide isolated neuromuscular activity. In this embodiment, stations five through nine provide more advanced integration of neuromuscular activity. Water pressure from behind engages anterior muscles. Water pressure from the side engages muscles on the contra other side.

In this specification "feed forward activation" refers to a process by which muscles "learn" how and when to contract or relax during certain phases of movement from inputs that isolate muscle activity. The learning occurs from correct positioning rather than from detecting errors and correcting them during the exercise. It does not require making a mistake in positioning to learn the correct position. This process happens on a neuromuscular level involving the muscles, nerve cells, brain, and other structures involved in the central nervous system. Unlike biofeedback, feed-forward activation is the ability of a muscle or group of muscles to learn a pattern of movement through repetition and correct input, without generating bad habits or compensatory patterns.

In the preferred embodiment, the correct input for feed forward activation is provided by directional movement of water on muscles. By having a patient complete an appropriately designed sequence, certain muscles of the body are pre-activated over and over again without having to use biofeedback. In time, these muscles integrate to anticipate this stimulus and therefore move in the correct manner even when the patient is on dry land.

The exercise may be considered as taking place in three planes, which are the transverse plane (horizontal), frontal plane and sagittal plane. This language does not literally mean these exact perpendicular planes but refers to motion in all degrees of freedom by the body. The transverse plane exercise inhibits the right back extensors, quadratus lumborum and posterior serratus and introduces right trunk rotation and counterclockwise movement. The frontal plane inhibits right adductors and left abductors of the hip and activates left adductors and right abductors of the hip. The sagittal plane exercises induce internal rotation (IR) at the left femoral-acetabular (FA) joint, right acetabular-femoral (AF) joint and induce internal rotation (IR) at the right glenoid-humeral (GH)joint and scapular complex. A tri-planar respiration exercise expands the right apical-chest and left pelvic floor and facilitates right trunk rotation, lumbo-pelvic counterclockwise movement, and decreases paravertebral, quadratus lumborum and posterior serratus activity. It also introduces right trunk rotation through counterclockwise movement of lumbo-pelvic femoral complex. Exercise in the sagittal plane with transverse plane inhibits hip flexors by activating trunk flexors (abdominals—left internal obliques and transversus abdominis and right external obliques).

This therapy improves balance by decreasing compensatory muscle tone and increasing symmetry of the body. Venous return and arterial flow improves as a result of resisted rotation. Hyperinflation of the lungs decreases as measured by a pool scale. In this specification, "proprioception" means the reliance on neuromuscular sensation to determine the position of body parts instead of sight. The alteration of visual cues for the patient making visual feedback and monitoring more difficult can cause reliance on proprioception. For the postoperative patient, this effect may be used therapeutically. For example, while immersed, a patient with a habitual visual method of joint placement (e.g. someone who looks at his feet to walk) may be forced to use his proprioceptive system instead.

From the above description, it can be understood that the method and apparatus of this invention has several advantageous features, for example: (1) it permits neuromuscular training in all three dimensions (three planes) instead of only one dimension (in only one plane); (2) it provides forward feedback rather than biofeedback as a training mechanism; (3) it is economical when used on a large scale since the same equipment can provide tailored therapy to many different patients; (4) it reduces and corrects compensatory patterns of neural motor tone that can be directly attributed to the effects of gravitational forces and the normal asymmetrical biomechanical functionality of the human body.

BRIEF DESCRIPTION OF THE DRAWINGS

The above noted and other features of the invention will be better understood from the following detailed description, when considered in connection with the accompanying drawings in which:

FIG. 9 is another embodiment of therapy station in accordance with the invention;

FIG. 10 is still another embodiment of therapy station in accordance with the invention;

FIG. 11 is a perspective view of another embodiment of the invention;

DETAILED DESCRIPTION

Figure 1:
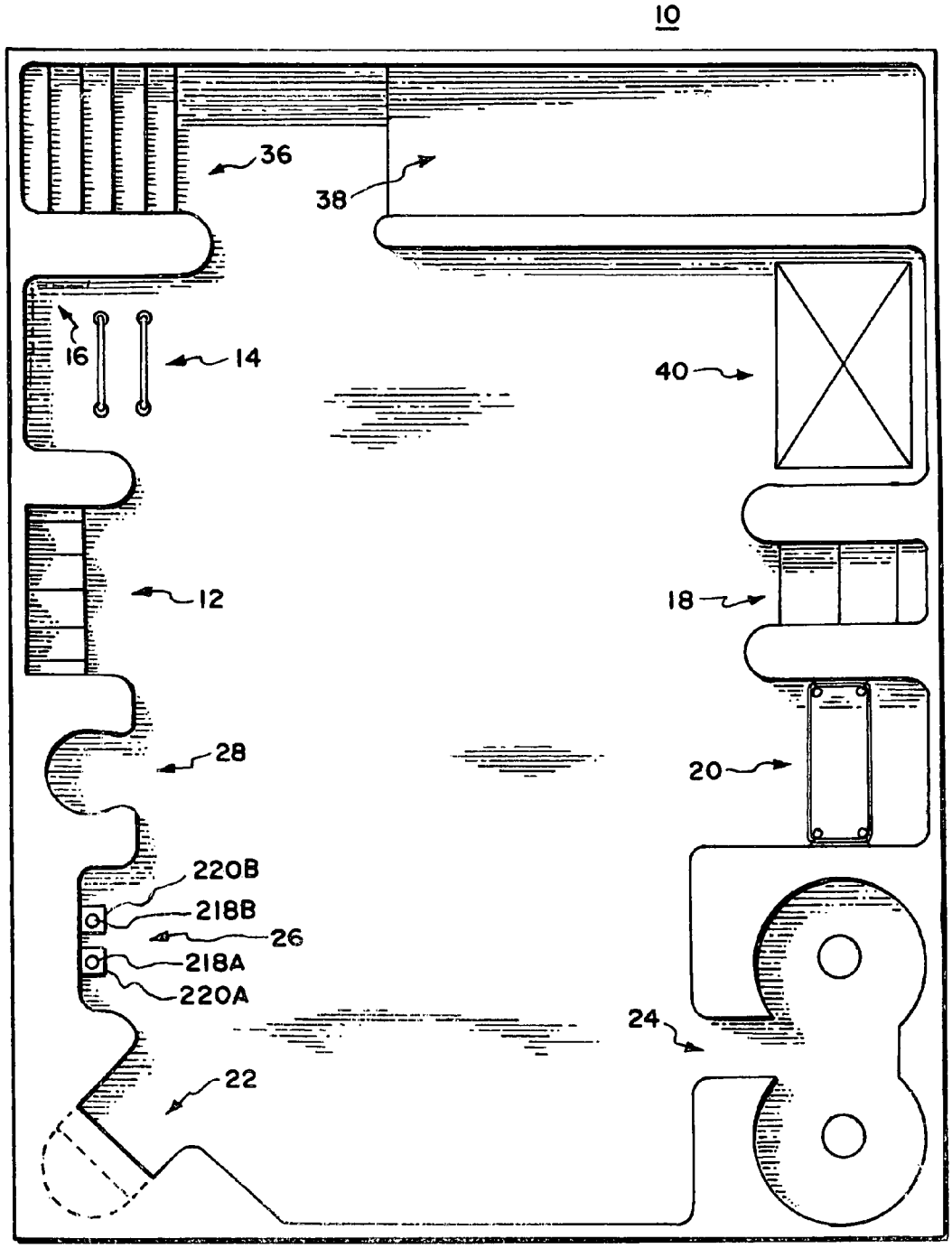
FIG. 1 is a simplified plan diagrammatic view of one embodiment of a physical therapy apparatus in accordance with the invention.

In FIG. 1, there is shown a simplified diagrammatic view of a therapy pool 10 having a plurality of individual therapy stations 12, 14, 16, 18, 20, 22, 24, 26 and 28, a stairway 36, a ramp 38 and an elevator 40. The details of the pool, such as the stairway 36, ramp 38 and elevator 40 and the water conditioning are not part of the invention and only function to accommodate the patient's entry into the pool. The height of the water in the pool is determined by the design and use of the stations as described hereinafter but in the preferred embodiment, the depth of the water in the pool is between 42 and 48 inches. In the preferred embodiment, the dimensions of the pool are 31 feet by 48 feet. Each of these stations provides repositioning of a body part. In the embodiment of FIG. 1, there are nine stations but there may be one station or any number of stations. Within the embodiment shown in FIG. 1, a plurality of spaced apart water nozzle outlets are provided. These outlets are located within each station to apply targeted and sequential forces to the body during motion exercises for patient repositioning and neuromuscular training in the pool. These forces provide three dimensional repositioning without feedback using feed forward training.

Besides reducing gravitational effects from the buoyancy of the body, the use of exercise in a pool has an additional benefit. A patient looking at his or her limbs during motion against the flow of liquid sees a distorted image because of the change in index of refraction between water and air. This prevents complete reliance on sight and permits better neuromuscular training.

The nine stations are: (1) station one for hip repositioning shown generally at 12 in FIG. 1 and shown in greater detail in FIGS. 2-5; (2) station two for repositioning the upper quadrant of the body (from waist upwardly) shown generally at 14 in FIG. 1 and in more detail in FIG. 9; (3) station three for lateral shifting exercises shown generally at 16 in FIG. 1 and shown in greater detail in FIG. 10; (4) station four for restoring normal acetabular-femoral internal rotation shown generally at 18 in FIG. 1 and shown in greater detail in FIGS. 11-14; (5) station five for restoring normal thoracic rotation, and facilitating abdominal obliques and hip rotators shown generally at 20 in FIG. 1 and in greater detail in FIG. 15; (6) station six for tight hamstrings, paravertebrals or stiffness of the trunk shown generally at 26 in FIG. 1; (7) station 7 for restoring normal reciprocal movement during gait between scapula-humeral joints and pelvic-femoral joints, maximizing rotation to the right from spinal segment T4 to T8 during clockwise locomotion with rotation to the left from the sacrum to T8 during counterclockwise locomotion and femoral-acetabular internal rotation to the left during clockwise locomotion, and reducing osseous and myosseous pathologies of extremities, girdle joints and spine shown generally at 24 in FIG. 1 and more specifically in FIGS. 16-19; (8) station eight for restoring normal tri-planar activity of the hip, maximizing full active tri-planar range of femoral movement, reducing femoral disease, imbalances of agonistic and antagonistic muscles, restoring normal hip extension and proper timing of hip rotation, and reducing pathologies associated with sacral tilt to the right and forward anterior pelvic orientation to the left shown generally at 22 in FIG. 1 and shown in greater detail in FIGS. 20-23; and (9) station nine for positioning the hip region for restoring normal sequential motion of the acetabulums on the femurs in a semi-loaded position and transversed plane shown generally at 28 and in greater detail in FIGS. 24-27.

Figure 2:
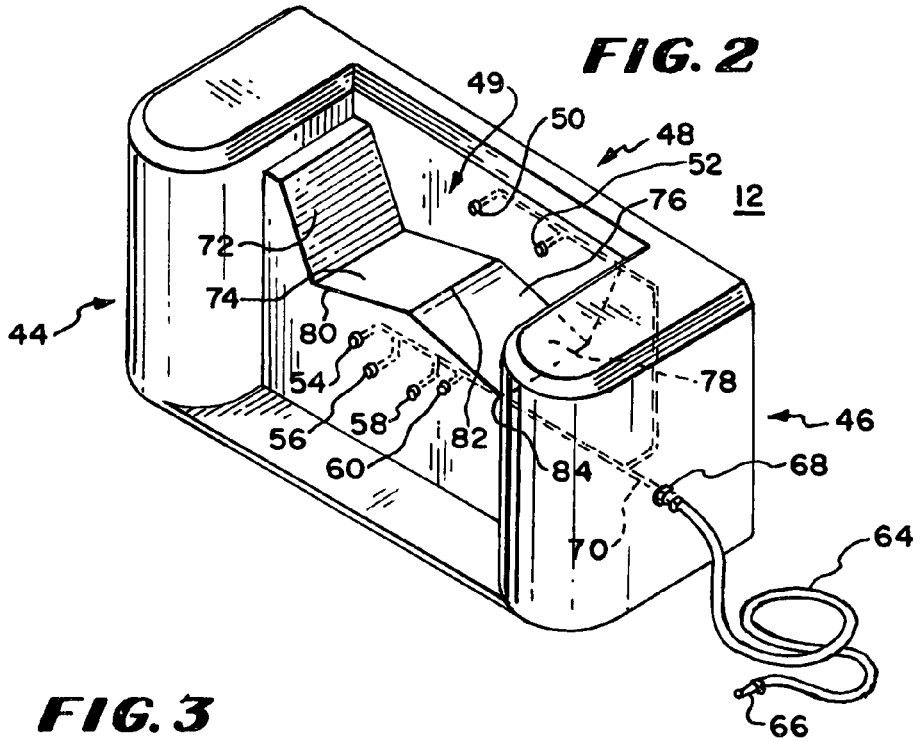
FIG. 2 is a perspective view of a therapy station in accordance with an embodiment of the invention.

In FIG. 2, there is shown a simplified perspective view of station one shown at 12 in FIG. 1, sometimes referred to as a water bench for hip repositioning in accordance with one embodiment of the invention. Station one includes a right side wall 44, a left side wall 46, a back wall 48 and a hip positioning section 49. The hip positioning section 49 includes a left slope 72 ending in a left low point 80, a center-left slope 74 extending from the left low point 80 to a center rounded peak 82, a center-right slope 76 extending from the peak 82 to the right low point 84 and a right slope 78 extending from the right low point upwardly.

This hip positioning section is shaped, sized and located to receive a patient in a reclined position with the patient's right side against the wall 48 or left side against the wall 48 for repositioning of the hip. An adjustable valve controls the momentum of the water hitting the patient. Valve openings for valves or nozzles 50, 52, 54, 56, 58 and 60 are adjustable from corresponding dials 50V, 52V, 54V, 56V, 58V and 60V (shown in FIG. 3). The valves may be of any suitable type, either directly connected to the valve dials or by remote signals.

This station can also be used with a seated patient's position centered along the bench with the patient's back to the wall 48. In this configuration, the four nozzles 54, 56, 58 and 60 act on the backside of the patients legs. In one exercise, the patient moves his/her legs in a swinging motion between a lower pressure stream close to the midline of the patient to a higher pressure stream away from the midline and from a position close to the nozzle outlet to a further position. These exercises are to cause the patient to feel and become conscious of his or her hamstring. This causes the patient to rotate the leg internally to a proper position. The therapist adjusts the rate of flow or cross sectional area of the stream until the patient feels his or her hamstring.

There is an additional water port located on the base of the bench for a portable nozzle attached to a hose and operated by a therapist for applying additional fluid force to targeted areas of the patient. In the preferred embodiment, all currents or streams of water are operated by a single pump and each nozzle's flow velocity can be adjusted individually. The direction of the nozzles 50 and 52 is adjustable. However, other arrangements of pumps and nozzles are possible such as several pumps for individual nozzles or groups of nozzles.

For applying hydraulic pressure to a patient while the hip of the patient is submerged, there is a left hip water outlet 50 in the back wall 48 and a right hip outlet 52 in the back wall 48 positioned to apply a stream of water against the left hip or the right hip respectively, depending on the position of the patient. The two currents of water or streams of water from the water outlets 48 and 50 are located eight inches below the water line and six inches below the center peak 82 The nozzles 50 and 52 that emit the currents of water may swivel to apply adequate momentum to a wider area.

In an alternate position of the patient with the patient's back against the back wall 48, repositioning of leg muscles may take place with a first leg opening 54, a second leg opening 56, a third leg opening 58 and a fourth leg opening 60 positioned to impinge on the muscles of the leg depending on where the patient is sitting. The nozzles providing the outlets 54, 56, 58 and 60 are adjustable in the diameter of their outlets but do not move so as to be directional. Instead the therapist positions the patient to receive the currents of water.

To supply fluid to the outlets, an internal large conduit communicates with the outlets 50-60. Fluid under pressure enters the conduit 70 through an inlet 62 and the pressure is controlled by the direction the nozzles are pointing and the adjustment setting on the outlet of the nozzles. In the preferred embodiment, the conduit is pressurized to a level that provides the required momentum to body part of the patient being treated. This pressure will vary in accordance with the location of the nozzles with respect to the water line but can be determined readily by the therapist. A hose 64 communicates with the internal conduit at 68 to supply pressure from the nozzle 66 under the control of a therapist.

Figure 3:
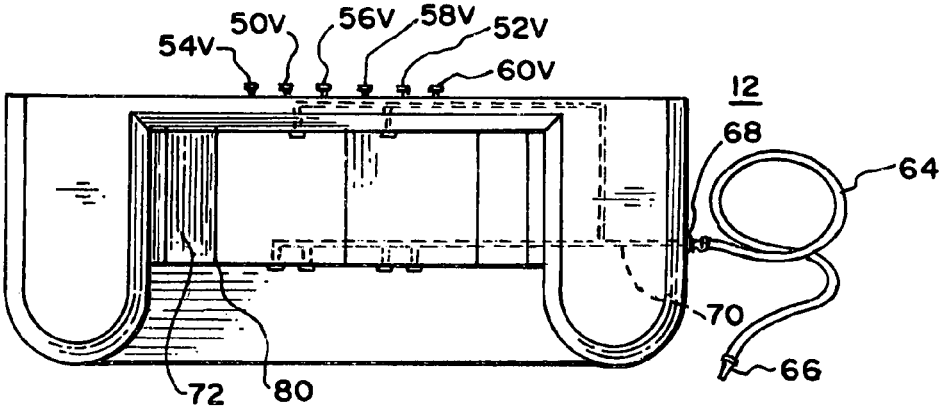
FIG. 3 is a plan view of the embodiment of FIG. 2.
Figure 4:
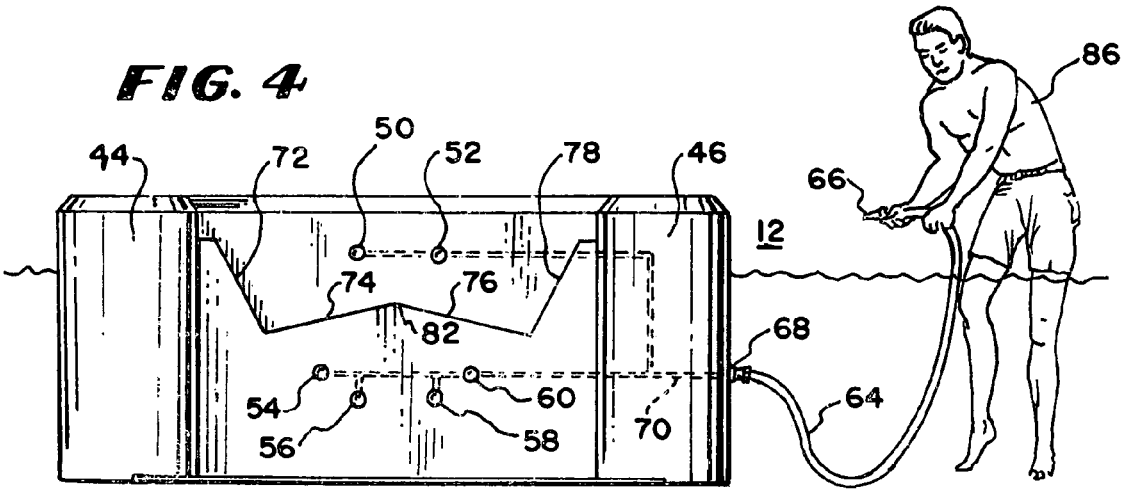
FIG. 4 is a front elevational view of the embodiment of FIG. 1.
Figure 5:
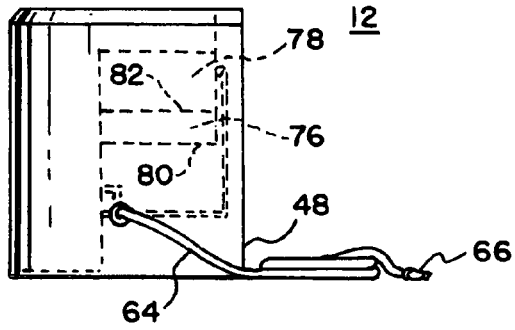
FIG. 5 is a right side elevational view of the embodiment of FIG. 2.

In FIG. 3, there is shown a plan view of the first station 12 showing the position of the outlet nozzles 50, 52, 54, 56, 58 and 60 as they would be used by a patient either reclining on the center section 49 or sitting on the section with his/her legs dropping over the edge where they may be impacted by the nozzles 54, 56, 58 and 60. In FIG. 4, there is shown an elevational view with a therapist 86 manipulating the hose 64 to impact selected muscles of a patient. In FIG. 5, there is shown an elevational view of the right side illustrating the location of the right slope 76, peak 82 and low point 80 as well as the nozzle 66 of the hose 64.

Figure 6:
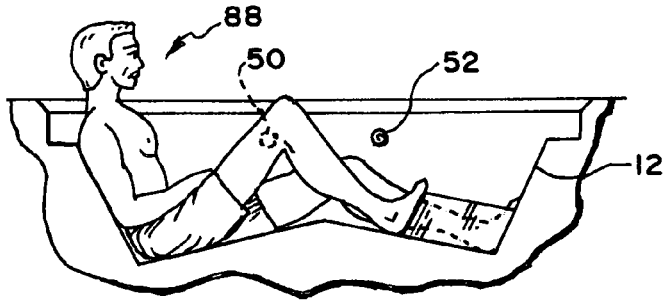
FIG. 6 is a schematic illustration illustrating a patient being treated in the embodiment of FIG. 1.

In FIG. 6, there is shown a simplified schematic view of a patient 88 reclined on the water bench with his right leg raised and his foot resting against a stool so that the stream from the nozzle 52 (not visible in FIG. 6) hits the right thigh of the patient 88 from the left side causing the patient to resist the force and rotate the patient's hip internally. The therapist asks the patient to bend his or her right knee so that it is at or above the water level. The patient's left foot can rest against another stool or other physical item of the proper size to remain against the water bench and submerged so that the stream of water from the nozzle 52 (FIG. 2) hits the patient's right thigh and inhibits right abductors and facilitates right adductors. The patient's foot is used by the patient to maintain his or her position against the tendency for the stream of water to move the patient outwardly from the bench because of the patient's buoyancy in the water. With this arrangement, the patient is forced to position his or her body properly and obtain feed forward neural learning of the proper hip rotation. The size of the opening from the nozzle (area and velocity of column of water hitting the patient's thigh) is set by the physical therapist for proper repositioning based on experience as described hereinafter.

Figure 7:
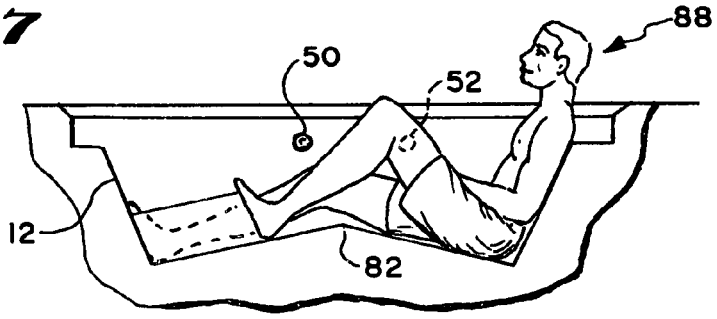
FIG. 7 is a schematic view of a patient being treated in the embodiment of FIG. 2.

In FIG. 7 there is shown a schematic view of the patient 88 reclining so that water pressure may be applied to the patient's right side. In this case, which is the more common situation, the stream of water from the nozzle 50 (FIG. 2) hits the inner side of the left leg to inhibit left abductor and facilitate the left adductors.

The purpose of this station is to: (1) restore normal frontal plane adduction and abduction of the hip and thorax by inhibiting sagittal muscle (back extensors and hip flexors) while positioned in a state of mediastinal flexion and maximum zone of apposition; (2) maximize left adduction without hip flexor assistance and with concomitant right acetabular control (this mimics left swing phase of gait during right mid stance); (3) maximize abdominal stabilization during perturbated single leg extension with frontal and transverse plane forces placed on the contralateral extremity; and (4) reduce pain patterns of the low back, mid back and neck secondary to abdominal imbalances, lack of adduction-abduction integration at the hip and trunk, and hyperinflation of the thorax.

The water bench station uses the position of the patient, controlled movement by the patient, and fluid force from the water nozzles in opposition to movement to perform its desired functionality. The streams or currents of water from nozzles 50 and 52 (FIG. 2) allow for abduction and adduction resistance according to the patient's position and which leg is being acted upon. When seated, the patient experiences femoral-acetabular internal and external rotation (FA IR and FA ER) from nozzles 54, 56, 58 and 60. The additional water port can provide portable resistance by a therapist to integrate adductors and abductors with other appropriate muscles in a pattern of movement. Rungs allow for increased or decreased rotation (increase knee flexion=increase transverse activity). This station is useful for repositioning a left AIC patterned patient. Nozzles aimed at the right side of the legs (inner left leg and outer right leg) mandates left AF IR while nozzles aimed at the left side of the legs (inner right leg and outer left leg) mandate right trunk rotation. It is also useful for left FA IR/adduction with concomitant right FA ER/abduction. It is also useful for trunk rotation with emphasis on maintaining pelvic neutrality. Indications for this treatment are chronic back conditions (examples: scoliosis, spondylolisthesis, spondylosis, etc.). In this exercise, the patient reaches with his or her left upper extremity to extend his or her right leg with a nozzle aimed at his or her left knee for FA IR.

Figure 8:
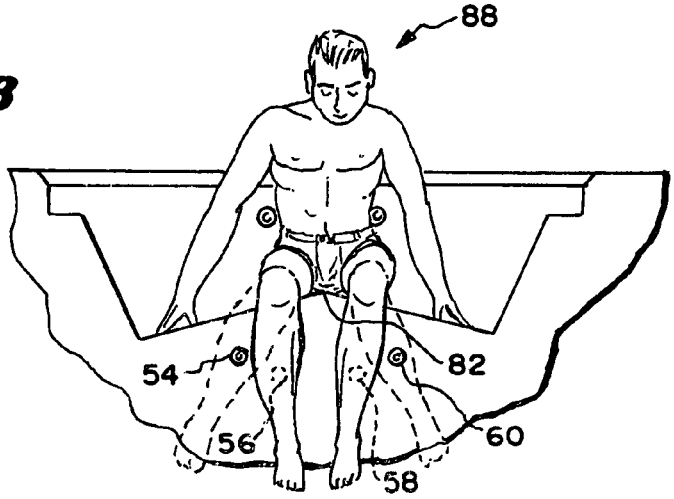
FIG. 8 is a schematic of a patient being treated in the embodiment of FIG. 2.
Figure 12:
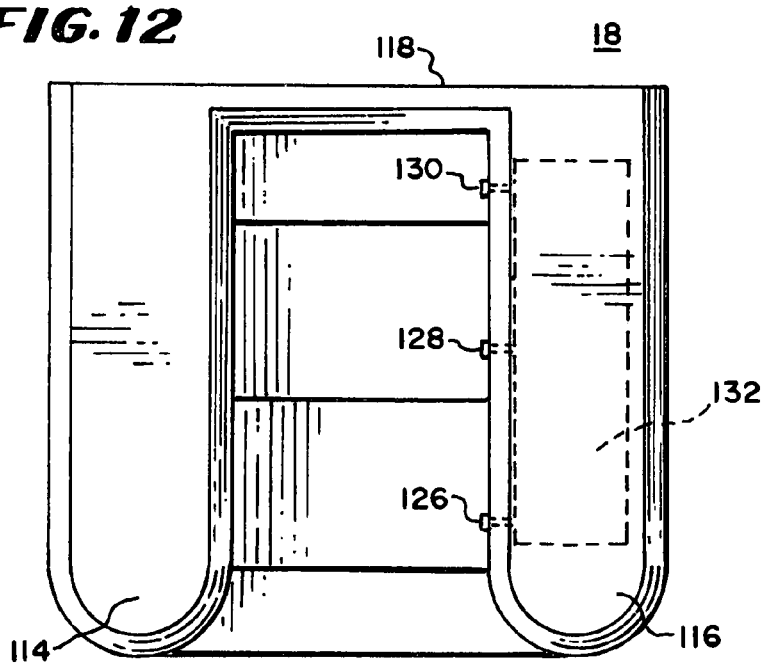
FIG. 12 is an elevational view of the embodiment of FIG. 11.
Figure 13:
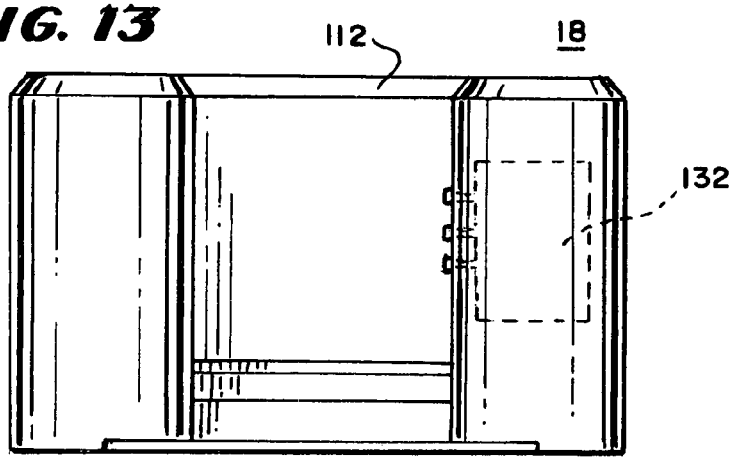
FIG. 13 is a front elevational view of the embodiment of FIG. 11.
Figure 14:
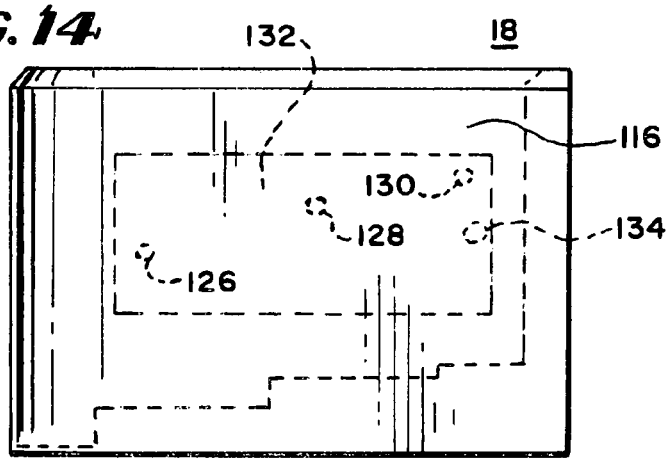
FIG. 14 is an elevational side view of the embodiment of FIG. 11.

In FIG. 8, the patient is shown sitting forward facing away from the water bench centered on the apex 82 (FIG. 4 shows the peak or apex 82 best) with the patient's legs over the edge of the station 1. In this position, the physical therapist asks the patient to move his or her right leg forward and then back against the water from the nozzle 56 while the patient moves his or her left leg forward as the right leg is moved back. This reciprocal motion is continued and the patient is asked to feel his or her hamstrings as the legs are pulled back against the streams of water. This exercise facilitates the hamstrings. While the patient is in this position, the physical therapist asks the patient to move his or her legs in a swinging motion away from the saggital plane and to internally rotate the femus and feel the hamstring as the water stream from nozzle 54 hits the right leg of the patient and the water stream from nozzle 60 hits the left leg. The water from nozzle 60 facilitates the left hamstring and hip internal rotators and the water stream from nozzle 54 facilitates the right hamstring and right hip internal rotators.

In FIG. 9, there is shown a simplified perspective view of station two which is a parallel bar assembly 90 having first and second parallel bars 92A and 92B with corresponding horizontal bars 98A and 98B each being support at its ends by vertical bars 94A, 94B, and 96A, 96B. The vertical bars are mounted to the bottom of the pool and the parallel bars are below the water level 100 in the pool. The parallel bars may be of any length but are spaced apart from each other a distance convenient to permit the patient to raise himself/herself up on the bars and lower himself/herself.

The focus of this station is upper quadrant activity. Some exercises performed here are: (1) ski shift for left AF IR; (2) retro walking or side walking; (3) press downs; (4) step overs; and (5) step arounds. These are standard exercises performed normally on dry land. A movable wand is used by the therapist to apply a stream of water with a flow rate of between zero and 1.5 feet per second measured one foot from the nozzle outlet while the patient performs these exercises. The wand or water gun may be aimed at the sacrum, pelvis, hips or legs to promote abdominal activation and inhibition of back extensors and to challenge dominant pathological patterns of movement. In the embodiment of FIGS. 1 and 9, the wand is a water hose 64 from station one. The height of the parallel bars is adjustable to accommodate different patients.

In FIG. 10, there is shown a simplified perspective view of station 3 at 102 having first and second perpendicular walls 104 and 106. The wall 104 has three outlets or nozzles 108, 110 and 112 in a horizontal line at the height of the spinal column and the wall 106 has one opening or nozzle 114 aimed at the hip of a patient. The third station is used for aquatic lateral shifting exercises. At this station, the patient is asked to perform a side to side motion as if ice-skating. In one form of the exercise, the physical therapist requests the patient to shift left and hold that position as water currents cause the patient to activate the left abdominals. The physical therapist may also ask the patient to keep his or her back rounded, not extended as they move from side to side to deactivate back extensors and activate the abdominal muscles with hip shift as force from streams of fluid emitted from the nozzles aimed at the back and hips try to push the patient forward. The patient moves from side to side without following, without extending his or her back and without extending knees. (The patient will have to squat and keep knees flexed.) The nozzle 114 is aimed at the right hip to resist the patient moving to the right and inhibiting the right abdominal muscles, facilitating the left abdominal muscles. The nozzle 108 hits the mid back and rear as the patient shifts his/her weight and trunk to the right—deactivating hip flexors and back extensors. The nozzle 110 hits the mid back and left rear when the patient moves to the right and hits the mid back and right rear when the patient moves to the left. The nozzle 112 hits the mid back and rear as the patient shifts his/her weight and trunk to the left—deactivating hip flexors and back extensors at the same time the left abdominal muscles are facilitated by the nozzle 114.

The purpose of this exercise is to: (1) restore the ability to shift laterally from side to side disengaging sagittal muscles of the neck, thorax and pelvis which interfere with unilateral frontal plane stabilizers and single leg extension during contralateral upper extremity facilitation; (2) maximize acetabular-femoral internal rotation while loading the entire femoral head for maximal kinesthetic awareness; (3) prevent falls contributed by lack of ability to adjust body weight in a frontal plane direction; (4) improve humeral scapular and thoracic scapular stabilization during eccentric and concentric humeral abduction and adduction; and (5) reduce shoulder and hip impingement, loss of dynamic single leg and arm balance skills, anterior acetabular labral compression, narrow base of support and fear of 'shifting' while in a state of thoracic flexion and hip extension.

One option for using this station is for the patient to stand facing the pool wall. Focus is on transverse and sagittal plane activity. Water pressure from the nozzle 108 is aimed at the left side of the patient which increases left shifting progression. In another option for using this station, the patient stands with their back towards the pool wall. Focus is on transverse and frontal plane activity. Three additional nozzles are activated. Nozzle 108 is on for engaging left abdominals (left internal obliques and right external obliques). Nozzle 112 is off to decrease a Left AIC pattern, increase left adductors integrating with right trunk rotation. Nozzle 110 is on for engaging abdominal muscles. All nozzles are on for PEC patients (Posterior Exterior Chain—high back extensor tone, bilaterally forward pelvis) and the pressure of nozzle 114 is increased. It is useful for: (1) reciprocal AF IR with concomitant abdominal activity; (2) frontal plane adduction; and (3) dynamic abdominal feed forward activation.

In FIG. 11 there is shown a simplified perspective view of station 4 shown at 18 in FIG. 1 sometimes referred to as a retro-stair stream station. This station includes left side wall 114, right side wall 116, a back wall 118, a lower step 120, a middle step 122, and top step 124 as shown in FIGS. 11, 12, 13 and 14. The three steps are of varying heights, approximately 2-6 inches. Along the right side wall 116 facing corresponding steps are the openings 126, 128, and 130 facing respectively the bottom step, the middle step and the top step at a location approximately hip high to the patient. the outlets or nozzles 126, 128 and 130 exerts a force on the patient from the left side when the patient's back is to the steps. Within the right side wall 116 is a pressurized water tank 132 communicating with each of the outlets 126, 128, and 130 which end in an adjustable nozzle. The tank receives water under a controlled pressure through the inlet 134.

The purpose of the retro-stair station is to: (1) restore normal acetabular-femoral internal rotation (especially on the left side) by inhibiting posterior hip capsule external rotators, tensor fascia latae as a femoral internal rotator, quadratus lumborum and quadratus femoris and hip abductors working in short ranges; (2) maximize sagittal, frontal and transverse activity of femoral-acetabular and acetabular-femoral joints (hips) and proper sacral iliac and knee and ankle function in a partial weight bearing position without experiencing harmful compressive forces through loaded transverse plane torque; and (3) reduce weight bearing compression through the hip complex, abnormal torsion through the lumbar sacral and sacral iliac joints and demands on the knee and ankle stabilizers in frontal and transverse planes.

It is useful for: (1) step ups using two, four, and six-inch steps with left AF IR dynamic feed forward activation for engagement of left hamstrings and right gluteus maximus in left AF IR; (2) sideways AF IR with contra lateral hip extension followed by hip lift followed by knee extension followed by hip extension.

In using this station, the physical therapist asks the patient to walk up the stairs backward leading with left leg and shifting left hip back and to the left—one step at a time so the left leg/foot goes up first and then the physical therapist asks the patient to shift body weight to the left as the patient's right foot goes to the same step as the left. The patient needs to learn how to shift his or her hip to the left and back to step up with left leg and balance as water is moving the body to the right and forward, therefore, disengaging left hip flexors and reinforcing use of left hamstring and gluts (hip extensors). As the patient moves further up the stairs—more weight is experienced and more demands are placed on anti-gravitational muscles and less on hip stabilizers, rotators and extensors. The nozzle 126 hits left outside posterior and superior hip. The nozzle 128 hits left outside, posterior and medial hip and the nozzle 130 hits left outside, posterior and inferior hip/thigh.

Figure 15:
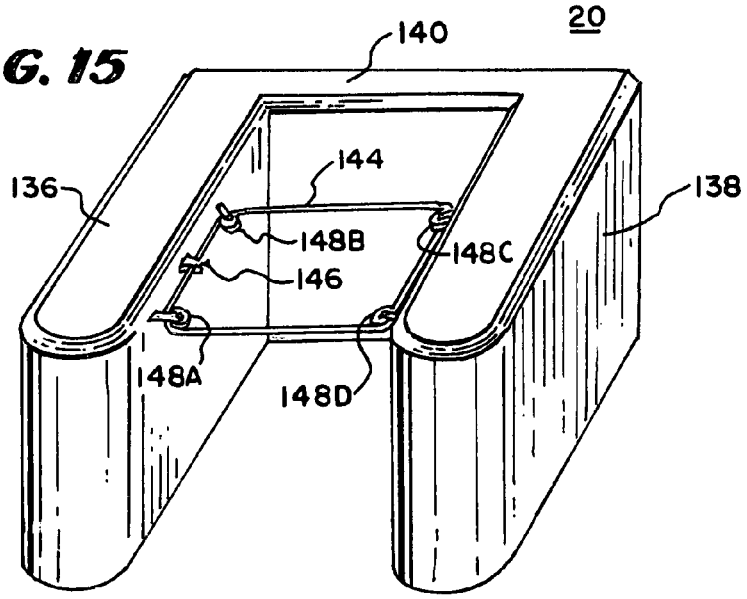
FIG. 15 is a perspective view of still another embodiment of therapy station.
Figure 16:
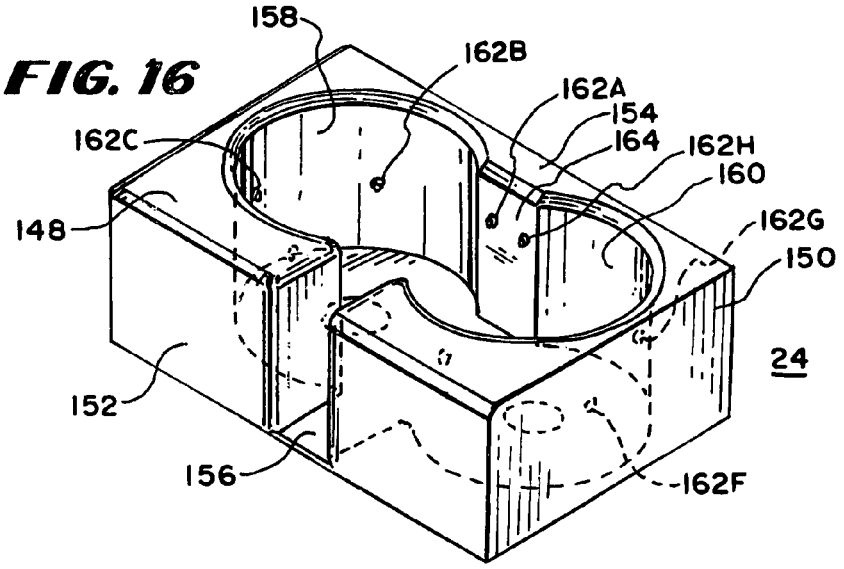
FIG. 16 is a plan view of the embodiment of FIG. 15.
Figure 17:
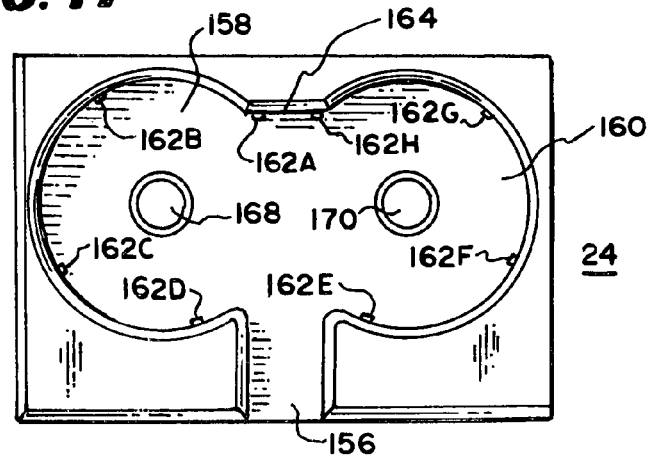
FIG. 17 is a front elevational view of the embodiment of FIG. 15.

In FIG. 15, there is shown a perspective view of station five shown at 20 having a left wall 136, a right wall 138, and a back wall 140. A rope 144 is formed as a loop in a horizontal plane between the left wall 136 and the right wall 138 held inplace by fourpulleys 148A-148D with 148A and 148B being mounted to the left wall 136 and 148C and 148D being mounted at spaced apart locations to the right wall 138. A clamp 146 is mounted to the left wall 136 and grips the rope 144 with adjustable tension. A patient faces the wall 136 and pulls against the friction or faces the wall 138 and pulls against the friction.

Station five is used for repositioning the patient's cervical curvature, thoracic curvature and lumbar curvature. In one exercise, the patient stands in the center of a loop of rope that has a preset resistance to motion from a clamp shown at 146, grips the section of the rope to his or her right with his or her right hand and the section of rope to his or her left with his or her left hand and pulls with one hand or the other against the resistance to movement. The patient is caused to reposition his or her body parts by the combination of buoyancy in the water and exercise. Because of the patient's buoyancy, the patients are repositioned from improper positions that may have been assumed over time to their proper position.

The purpose of this station is to: (1) restore normal thoracic rotation with single leg support by inhibiting anti-gravitational muscles of the thoraco-lumbar system and facilitating abdominal obliques and hip rotators—securing lower spine and single lower extremity stability during full thoracic rotation in the water—decreasing patterned compensatory demands on the upper quadrants, neck and upper back when on dry land; (2) maximize isometric transverse activity of the lower muscle chains, pelvis and lower extremity with maximum isotonic activity of upper muscle chains, shoulder, and upper extremity; and (3) reduce sacral iliac torsion and compression, thoracic hyperextension, upper trap-occipital tension and anterior brachial/pectoral tightness.

This highly integrative activity is used to reverse a left AIC pattern to a right AIC pattern. It is indicated for patellofemoral pain, sacral iliac instability, low back pain, groin impingement and scapula thoracic issues such as thoracic outlet syndrome. This station can be used for: (1) left AF IR with left trunk rotation engaging right gluteus maximus, left abdominals, right tricep, right lower trap and bilateral quads without hip flexion through inhibition of left vastus lateralis and activation of adductors and vastus medialis; (2) left AF IR right apical expansion with left shoulder pushing and right shoulder pulling; (3) tug-of-war with right trunk rotation or with left trunk rotation: and (4) reach, hold, and pull for feed forward, reciprocal pattern.

In use, in one exercise, the physical therapist asks the patient to stand next to one rope, with the rope passing the left lateral side of the patient. The patient's left and right hand are grasping the rope. The therapist asks the patient to pull the rope back by placing one hand in front of the other in an alternate manner. The patient will experience resistance on the rope as determined by the therapist that will create necessary activity from left abdominal obliques and musculature that inhibits right trunk rotation while standing primarily on the right lower extremity, since the demands of this activity places more weight on the left lower extremity, and center of gravity will shift to the left.

In another exercise, the physical therapist asks the patient to stand between two ropes, with one hand on one rope and the other hand on the other rope. The left leg of the patient will be behind the right leg with both feet pointed straight ahead and in line with each other. The patient will then be asked to move his/her left hand forward by pulling his/her right hand back to replicate normal gait, trunk rotation associated with arm and leg alternating, reciprocal function in the correct non-compensating manner of the body during gait, running, etc.

Doing these activities in four feet of water creates a demand on the patient to work at securing his/her feet on the pool floor for dynamic closed chain activity that deactivates hip flexors, back extensors and planter flexors, thus creating a more erect, anti-gravitational and stable human form, structurally. It decreases all tension at the neck and lower back that compensate for gravity demands when gluts, hamstrings, quads and abdominal muscles don't kick on because of improper tri-planar patterned activity.

The sixth station (shown at 26 in FIG. 1) is used for wall resistance/reach exercises. This station consists of a moveable support including movable hand grips 218A and 218B and resistance 220A and 220B connected by ropes and pulleys to weights so that pulling the hand grips 218A and 218B lifts the weights to provide a resistive or elastic material. The patient performs controlled movements against this resistance.

The purpose of this station is to: (1) restore normal trunk flexion through the mid-thorax by inhibiting back extensors, latissimus dorsi and pectoralis muscle and facilitating abdominal obliques and transversus abdominis; (2) maximize sagittal and transverse activity of vertebrae, rib cage and hips; and (3) reduce vertebral joint compression, thoracic hyperinflation, cervical, lumbar and inter/supra scapular strain and lumbar stenosis and spondylolisthesis.

It is useful for single leg dynamic stance activities with tubing to reduce hip flexion, back extension, FA ER, AF ER, and brachial chain over-activity. The patient's functional requirement is that the patient must be able to squat in order to submerge his/her lungs for abdominal activation. The patient's indication for this therapy is PEC patients (Posterior Exterior Chain) or patients with tight hamstrings, paravertebrals or stiffness of the trunk. A comparable activity is the resisted wall reach and trunk arounds. The physical therapist asks the patient to stand with his or her back towards the pool wall and with each hand in a loop of theraband that passes behind the patient to a hook that can be adjusted accordingly to the patient's height.

The therapist instructs the patient to round out his/her back, as he or she leans forward and squats. He/she is asked to reach forward without falling, losing balance until the head reaches the surface of the water. Aquatic blocks will be placed under the patient's feet to match appropriate dimensions of submersed body parts of patient, so reaching, trunk flexion and squatting against resistance can occur, while the patient breathes.

The patient will need to learn how to perform this necessary dry land activity in a buoyant environment, therefore disengaging back extensors, hip flexors and engaging back/torso flexors (abdominal muscles) and hip extensors so that typical spastic/tense muscle of neck, scapula and back can reduce.

Figure 18:
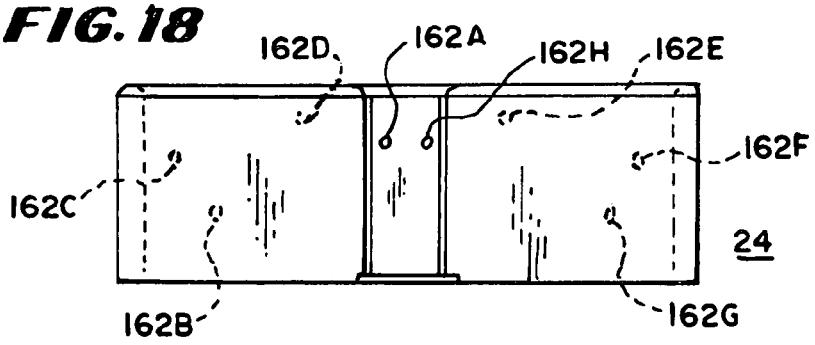
FIG. 18 is an elevational side view of the embodiment of FIG. 15.
Figure 19:
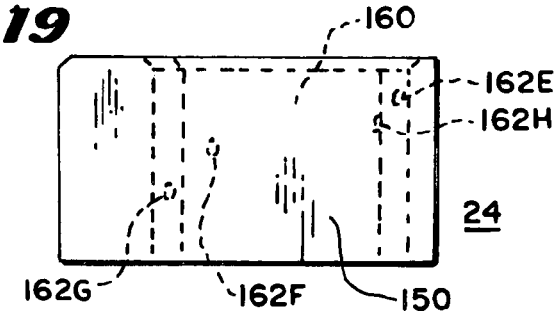
FIG. 19 is still another embodiment of therapy station in accordance with an embodiment of the invention.
Figure 20:
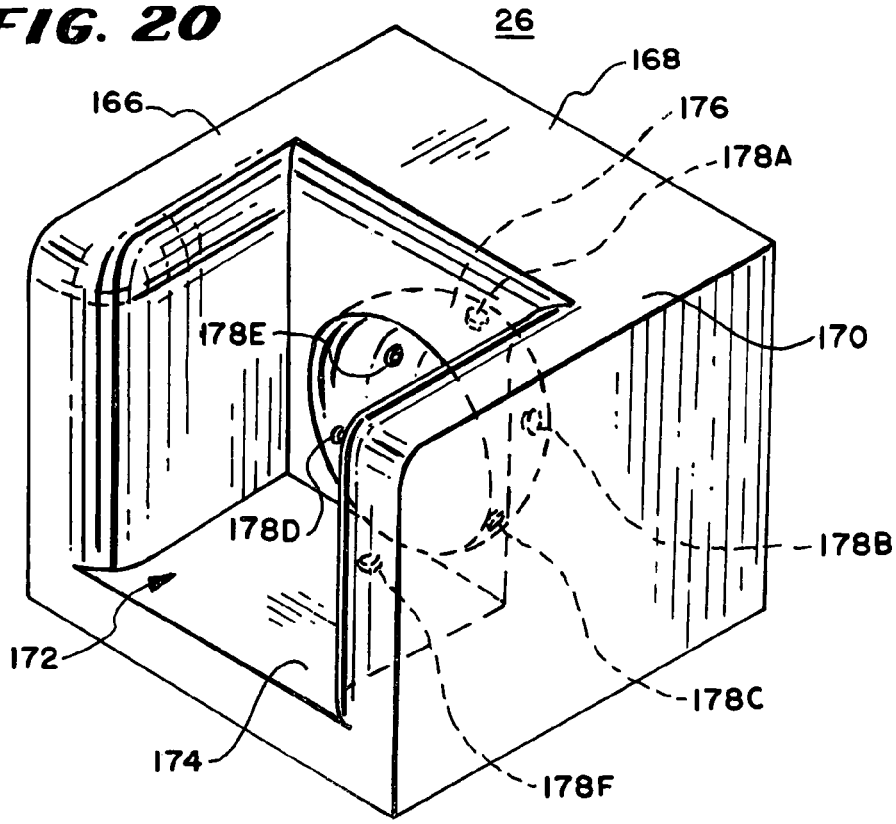
FIG. 20 is still another embodiment of therapy station in accordance with the invention.
Figure 21:
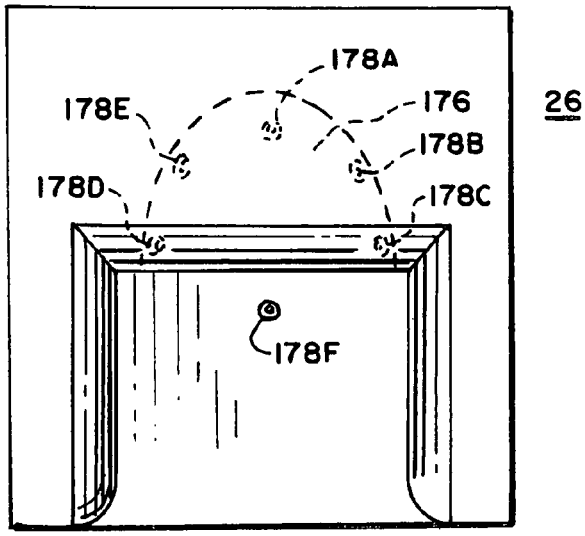
FIG. 21 is a plan view of the embodiment of FIG. 20.
Figure 22:
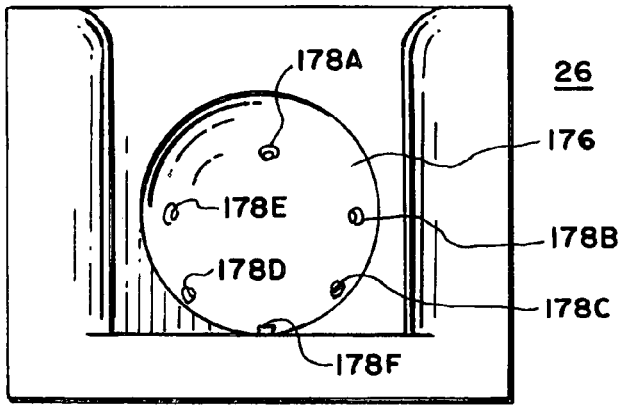
FIG. 22 is a front elevational view of the embodiment of FIG. 20.
Figure 23:
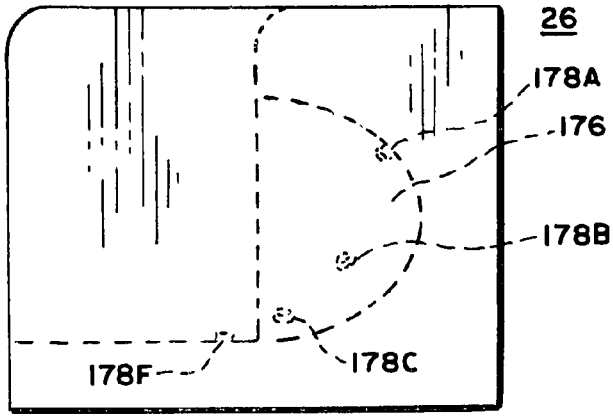
FIG. 23 is a right elevational view of the embodiment of FIG. 20.
Figure 24:
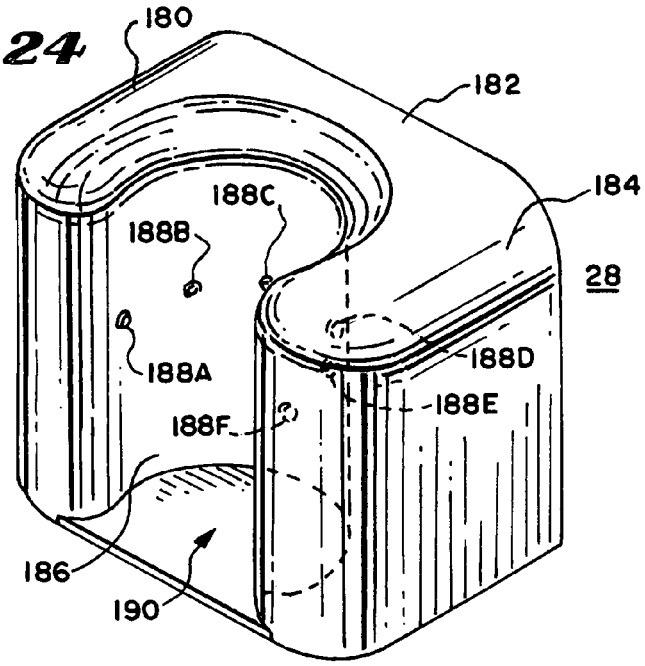
FIG. 24 is a perspective view of another embodiment of therapy station in accordance with the invention.
Figure 25:
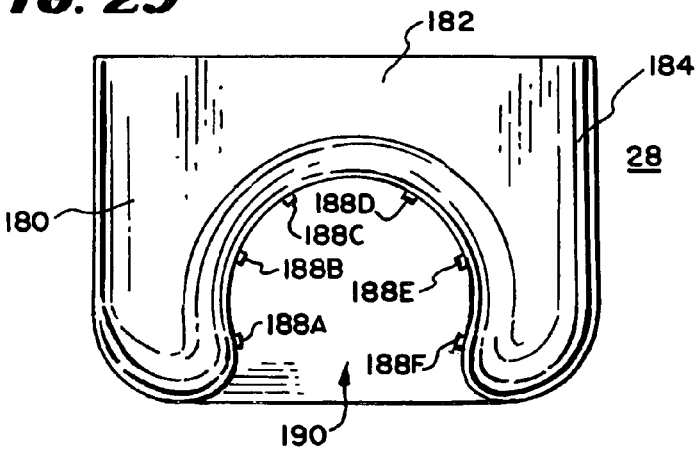
FIG. 25 is a plan view of the embodiment of FIG. 24.
Figure 26:
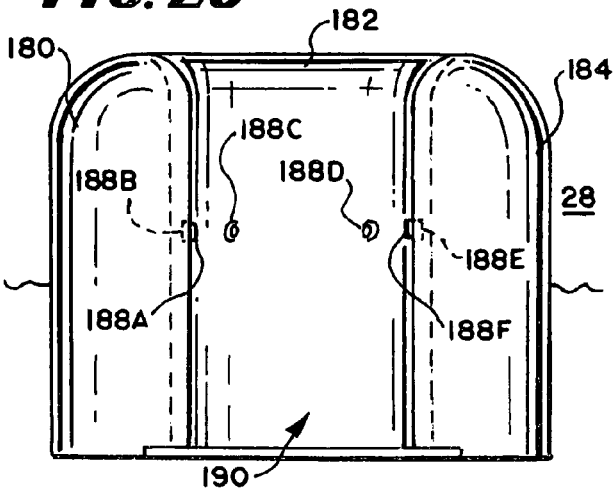
FIG. 26 is a front elevational view of the embodiment of FIG. 24.
Figure 27:
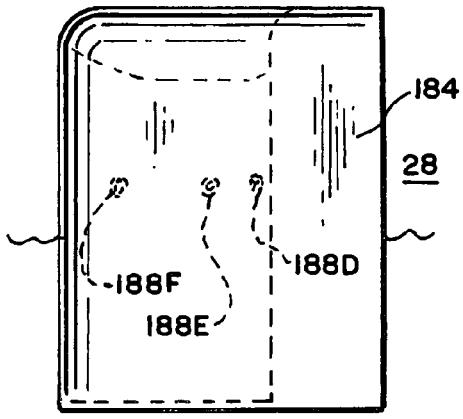
FIG. 27 is a right elevational side view of the embodiment of FIG. 24.

In FIGS. 16-19, there are shown respectively a plan view, a front elevational view and side elevational views of station seven shown at 24 having a left side wall 148, a right side wall 150, a front wall 152, a rear wall 154, and an entrance 156. Within the side, front and rear walls 148, 152 and 154 are two joined circular areas 158 and 160 having spaced apart outlets 162A-162H mounted at different elevations but spaced apart around the circular openings 158 and 160. Directly opposite the entrance 156 is a relatively straight section 164 forming a corridor connecting the circular portions 158 and 160. In the center of the circular portion 158 is an inlet portion 168 and at the center of the circular portion 160 is mounted at the bottom a circular portion 170 serving as an inlet. As best shown in FIG. 18 the openings 162A and 162H are at the same elevation in a horizontal plane whereas the circular outlet 162D is higher, the outlet 162E is in the same plane and the outlet 162E is lower. Similarly, within circle 160, the outlet 162F is lower than the outlet 162H, the outlet 162G is the lowest and intermediate between the two is the outlet 16H. A patient goes clockwise in one of the circles and counterclockwise in the opposite circle while the differently spaced outlets impinge on the patient to adjust and reposition the patient's limbs.

This station's two circular chambers have water flowing clockwise in one section and counterclockwise in the other section. There are four nozzles per section causing the directional flow while also targeting selected sections of the body. There are also two rotating disks at the center of each circular section to be used for the lazy susan exercise described below.

The purpose of this station is to: (1) restore normal reciprocal movement during gait between scapula-humeral joints, and pelvic-femoral joints by inhibiting left hip flexors, right thoracic side benders (quadratus femoris/lumborum), left vastus lateralis (as an abductor), right vastus lateralis (as an internal rotator), right latissimus dorsi, right adductor, right intercostals, right pec minor and left pec major and by facilitating left hamstrings, right glutes, left abdominal obliques and transversus abdominis, left diaphragm (as a respiratory muscle) and left adductor; (2) maximize rotation to the right from spinal segment T4 to T8 during clockwise locomotion with rotation to the left from the sacrum to T8 during counterclockwise locomotion and femoral-acetabular internal rotation to the left during clockwise locomotion; and (3) reduce osseous and myosseous pathologies of extremities, girdle joints and spine as a result of compensatory activity associated with normal right neuromuscular dominance, diaphragm respiration and left visual midline patterned asymmetrical activity.

The functionality of this station is achieved as the patient walks in a counterclockwise direction against the clockwise flow of water in the left section 158 (leading with their left upper extremity and right extremity reciprocally) while nozzles facilitate left AF IR repositioning. In the right chamber 160, the water flows counterclockwise for neuromuscular re-education. The breakdown of nozzle operation in the left section as the patient moves in a counterclockwise direction is as follows: (1) the nozzle 162A applies water with a force directed to facilitate left abdominals and right gluteus maximus; (2) the nozzle 162B applies a force directed at the right pelvis for facilitation of the left hamstrings, left adductors and left lumbo-pelvic-femoral internal rotators (left AF IR); and (3) the nozzles 162C and 162D apply force directed at the right mid trunk to facilitate abdominal wall for left lower rib internal rotation and to allow for right spinal rotation. In the right section 160, the nozzles are designed to interact with the patient while moving in a clockwise direction as follows: (1) the nozzle 162H applies force directed to the left hip for facilitation of right AF ER engaging the right gluteus maximus and the left abdominal obliques; (2) the nozzle 162G applies force directed at the left inner thigh and the lower leg for facilitation of left AF IR engaging the left adductors; and (3) the nozzles 162F and 162E apply force directed at the left thigh and left pelvis for engagement of the left anterior gluteus medius fibers.

This station is useful for: (1) left AF IR with left trunk rotation & feed forward resistance to reduce left AIC & right BC pattern; (2) sequential resistance to engage left ischiocondylar adductor followed by engaging the left external obliques for left trunk rotation followed by engaging the right external obliques and left internal obliques for trunk flexion, right lower trapezius/interscapular muscles for left trunk rotation and left hamstrings in counterclockwise direction; (3) sequential resistance to engage anterior gluteus medius with ischiocondylar adductor for left FA IR followed by engaging left external obliques and right internal oblique for trunk flexion and right trunk rotation followed by engaging the left oblique/transverse abdominals for increase in left zone of apposition and right apical expansion in clockwise direction; (4) resistance to reduce reciprocal clockwise (Left AIC) strategical pattern and improve strategical stability in counterclockwise (Right AIC) pattern.

The seventh station also is useful for the Lazy Susan exercise. This exercise is used for left AF IR development through dynamic single leg stabilization against selected levels of resistance in height and force based on the patient's morphism, size and neuromuscular control. It is used for: (1) step throughs and step overs; (2) step arounds; and (3) scooter boards against water current on the left; (4) AF ER development; and (5) right trunk rotation with right AF ER on the right.

In the use of this station, the physical therapist instructs the patient to walk to the left after entering this station's entrance 156. The therapist will select or modify jet streams from the jets to introduce moderate to maximum resistance across the patient's right anterior, frontal body as the patient walks counterclockwise. The patient will be instructed to pause at each cycle at nozzle 162A with right hip facing the jet to engage left abdominal muscles and disengage right lower extremity demands. The patient will learn, in a feed-forward manner, how to ambulate with proper gait, while resistance increases sequentially in a manner known in the art and literature as the postural restoration institute sequential movement of extremities with proper sequenced, timed trunk activity first; i.e., normal dry land upright characteristic human support muscle will be inhibited and desirable non-working muscle (internal rotators, abdominal muscles, and hip extensors) will now engage because of reclaimed or restored symmetrical trunk position via this station's water movement. The patient needs to breathe in through the nose and out of the mouth, "secure" one foot on moveable rotating disc 168, before lifting the next, and move right hand with left leg, and left hand with right leg.

The nozzle 162A hits the patient's right hip to distort right LE compensatory dry land function. The nozzle 162B hits anterior right pelvic to begin left torso rotation. The nozzle 162C hits right mid torso with slightly more velocity. The nozzle 162D has the strongest flow and hits the patient's anterior right frontal chest wall to reinforce the need for the left abdominal muscles and right apical expansion.

In another use, the physical therapist asks the patient to walk clockwise beginning in front of the nozzle 162H (to disengage right inner thigh) with the jet hitting the left lateral hip. The patient is instructed to walk with reciprocal normal gait as before, keeping one foot solely secured to the floor at all times. The patient will feel water thrusted first on left inner knee (nozzle 162G) then on left upper inner thigh (nozzle 162F) and then on left anterior pelvis (nozzle 162E) to reinforce patient's need to internally rotate left leg when on right secured leg. Unlike the counterclockwise left chamber 158, here the water will be slightly more forceful in the beginning (nozzle 162G) than at the end (nozzle 162E) to quickly get the left adductors and anterior left glute medius to fire or contract and the right adductors to relax.

The physical therapist asks the patient to place his/her left foot on a lazy susan circle 168 in the left chamber 158 and try to "secure" the circle as he/she raises his/her right leg/foot and advance. The same instructions would be given to the patient when in the right chamber—right foot on lazy susan 170, left foot on the pool floor. The only exception being, when in the right chamber, the patient may be asked to move his/her right foot on the circle outward while left adductor is facilitated by water flow. This co-contraction of the left adductor to the right glut max reverses pathologic PRI pattern. All water movement by nozzles 162A-162H would be the same as above.

In FIGS. 20-23, there is shown a perspective view, plan view, front elevational view and side elevational view of station 8 referred to as a rotational cove 26 having a left side wall 166, a rear wall 168, a right side wall 170, an entrance 172, and a floor 174. An elliptical hemisphere 176 is recessed into the rear wall 168 and includes five spaced apart outlet nozzles 178A-178E. A sixth nozzle 178F extends from the floor at a location adjacent to the elliptical hemisphere 176 and centered laterally. The station is designed for multiple patient positions and exercises so each nozzle can be controlled individually.

The purpose of this station is to: (1) restore normal tri-planar activity of the hip without abnormal shearing compressive force, dysynchrony and asynchrony muscle function by inhibiting left sagittal hip flexors acting as rotators, left hip abductors and external rotators and right adductors and internal rotators in frontal and transverse planes, respectively; (2) maximize full active tri-planar range of femoral movement without restrictive acetabular position; (3) reduce degenerative femoral-acetabular disease, femoral trochanteric bursitis, hip labral impingement syndromes, imbalances of agonistic and antagonistic muscles and improper activation of digital vs. proximal lower extremity stabilizers and movers; (4) restore normal hip extension and proper timing of hip rotation by inhibiting back extensors, hip flexors, knee extensors, plantar flexors and spinal compressors; (5) maximize feed forward sequencing of sagittal and transverse activity of right acetabular-femoral external rotation, left femoral-acetabular extension and left femoral internal and external rotation in a suspensory, unloaded position; (6) reduce joint compression forces with rotation of a non-weight bearing extremity during hip extension; (7) improve normal left hip extension and rotation with right spinal orientation; and (8) reduce stenosis, scoliosis and other pathologies associated with sacral tilt to the right and forward anterior pelvic orientation to the left, such as anterior knee pain, femoral patella pain, lateral meniscal compression, medial meniscal tears, ankle instabilites, posterior tibial tendonitis and plantar fascitis.

These objectives are achieved using this station in four different patient positions. First, the patient can be standing with his/her left or right side facing the wall 168 with the elliptical void 176. In this position, the nozzle 178A acts as an abduction nozzle by applying pressure to the outside of the patient's leg. The second patient position is seated while facing the void 176. In this position, the nozzle 178F acts as a thigh elevator for seated passive femoral lift on the active hip socket during femoral acetabular internal or external rotation (FA IR or FA ER) exercises. For the left leg, the nozzle 178C is used for FA ER and the nozzle 178D is used for FA IR. The opposite is true for the right leg, the nozzle 178C is used for FA IR and the nozzle 178D is used for FA ER. Also, the patient can stand with their back facing the wall with the elliptical void. An adjustable pad will be present to make sure the patient is in the correct configuration while they extend either leg into the void. In this position, the nozzle 178A serves as a glute nozzle resisting motion towards the wall. The nozzles 178B and 178E act as internal and external rotation nozzles according to which leg is being acted upon. Finally, the elliptical shape of the void allows for normal "ball in socket" activity while standing on one leg facing the wall with the elliptical void and moving the leg around the inside surface of the void.

In FIGS. 24-27, there is shown respectively a perspective view, a plan view, a front elevational view and a right side view of the 8th station 22 for positioning the hip region for restoring normal sequential motion of the acetabulums on the femurs in a semi-loaded position and transversed plane having a left side wall 180, a rear wall 182, a side wall 184, a right cylindrical central open portion 186, six outlet nozzles 188A-188F, and an entrance 190. The nozzles 188A-188F are circumferentially spaced about the cylindrical opening at a vertical level of approximately hip level. This station consists of a cyclindrical walled section where the patient stands at the center. The nozzles 188A-188F are symmetrically placed around the cylinder at a height to apply a rotational force to the patient's hip region. The nozzles can be adjusted to induce clockwise or counterclockwise flow. They also can be sequentially activated to vary the amount and position of force on the patient.

The purpose of this station is to: (1) restore normal sequential motion of acetabulums on femurs in a semi-loaded position and transverse plane. This activity requires cooperation and integration of multifidus, abdominal obliques, transversus abdominis, pelvic floor, femoral-acetabular rotators, acetabular-femoral stabilizers and spinal-pelvic stabilizers; (2) maximize adduction, abduction, flexion and extension of acetabular rotational movement without over compensation of femoral-acetabular rotators; (3) reduce proprioceptive and mechanoreceptor inadequacies of the acetabulum, lumbar sacral and sacral iliac joints; and (4) reduce form closure limitations and restore force closure skills for re-acquisition of neuromuscular strategies associated with single leg balance skill development.

The physical therapist asks the patient to stand with back towards the pool wall, and either asks the patient to: (1) hold trunk steady as water is sequentially moved clockwise or counterclockwise sequentially (nozzle 188A less force—nozzle 188F more force sequentially or visa versa); (2) hold trunk steady while balancing on one leg with watch movement directed and modified as above by physical therapist; (3) move hips and torso with water flow; and (4) move hips and torso against directed water flow.

The patient will feel the need to engage glutes, quads, hamstrings and abdominal muscles and disengage hip flexors, back extensors and upper traps to de-rotate and re-align trunk neurologically and then structurally while going back to dry land activity. All jets can be reversed in direction clockwise or counterclockwise and can be independently adjusted for flow.

Figure 28:
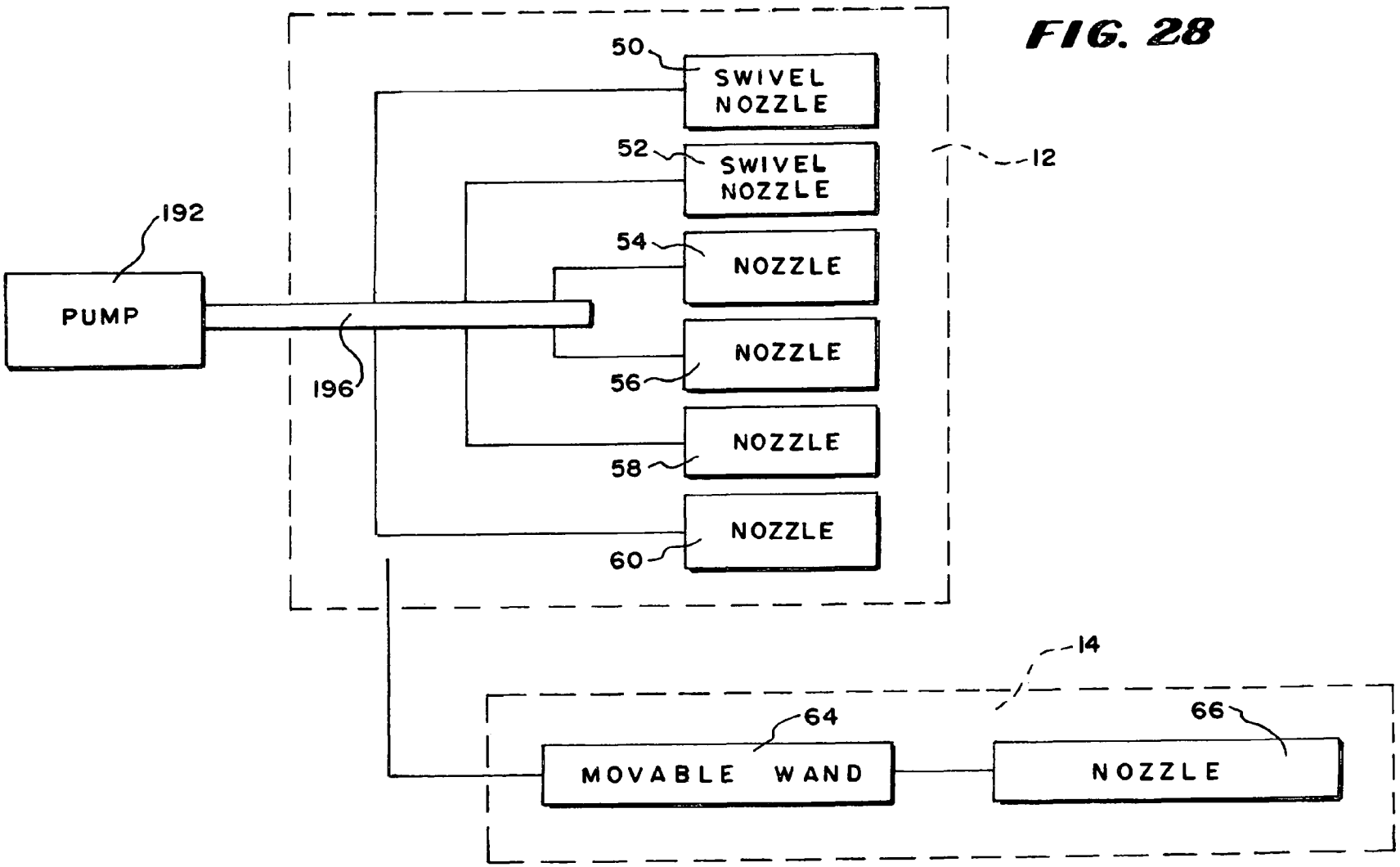
FIG. 28 is a schematic diagram of the water nozzle assembly for the embodiments of FIGS. 2 and 9.

In FIG. 28, there is shown a schematic diagram of the water flow for the first station shown at 12 and the second station shown generally at 14 having a pump 192, a pressurized conduit 196, swivel nozzles 50 and 52 for station one and nozzles 54, 56 and 58 and 60 also for station one and having a movable wand 64 and a nozzle 66 for station two. The pump 192 pressurizes the conduit 196 to provide the desired flow rate from the nozzles 50, 52, 54, 56, 58 and 60. The swivel nozzles 50 and 52 have an output flow rate of between zero and three feet per second measured at one foot from the nozzles and adjustable within that range. The nozzles 56 and 58 at the center of station one facing outwardly are adjustable between zero and 3.5 feet per second and the outer nozzles 58 and 60 have a higher flow rate of 5.2 feet per second. These flow rates are adjustable by the therapist and for some applications, may be adjusted to a higher flow rate. In this embodiment, the pump 192 is a 1.5 horsepower pump but of course many different kinds of pumps are available and different horsepowers may be provided. The nozzles are generally 1.5 inches in diameter but are adjustable downwardly. The flow output from the nozzle 66 on the portable wand 64 is adjustable between zero and 11.6 feet per second.

Figure 29:
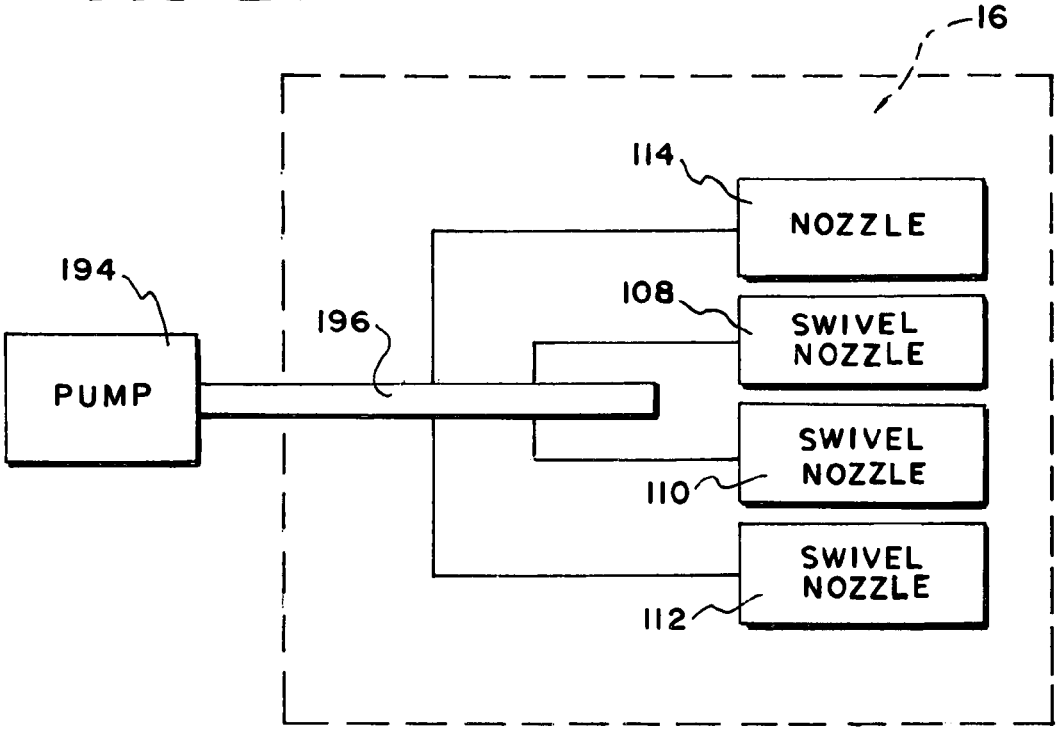
FIG. 29 is a schematic diagram of the water nozzle assembly for the embodiment of FIG. 10.

In FIG. 29, there is shown a schematic diagram of the fluid system for the third station shown generally at 16 and intended to provide lateral shifting exercises. In this station 16, there is provided a pump 194 and a main conduit 196 similar to the embodiment of FIG. 28. Four nozzles 108, 110, 112 and 114 are provided with the nozzle 114 extending from one wall and the nozzles 108, 110 and 112 being aligned at a same elevation on the other wall. The pump 194 in this embodiment is a two horsepower pump. The first nozzle 114 has a flow rate measured one foot from the wall of between 2.6 and 8.4 feet per second measured at two feet from the wall of one foot per second to 2.8 feet per second and measured three feet from the wall with a minimum of one foot per second and 2.7 feet per second. The other three nozzles have a flow rate measured one foot from the wall of between 3.1 and 5.5 feet per second and measured two feet from the wall of one foot per second to 1.3 feet per second in the preferred embodiment. Of course it may be designed with other values as chosen by the physical therapist.

Figure 30:
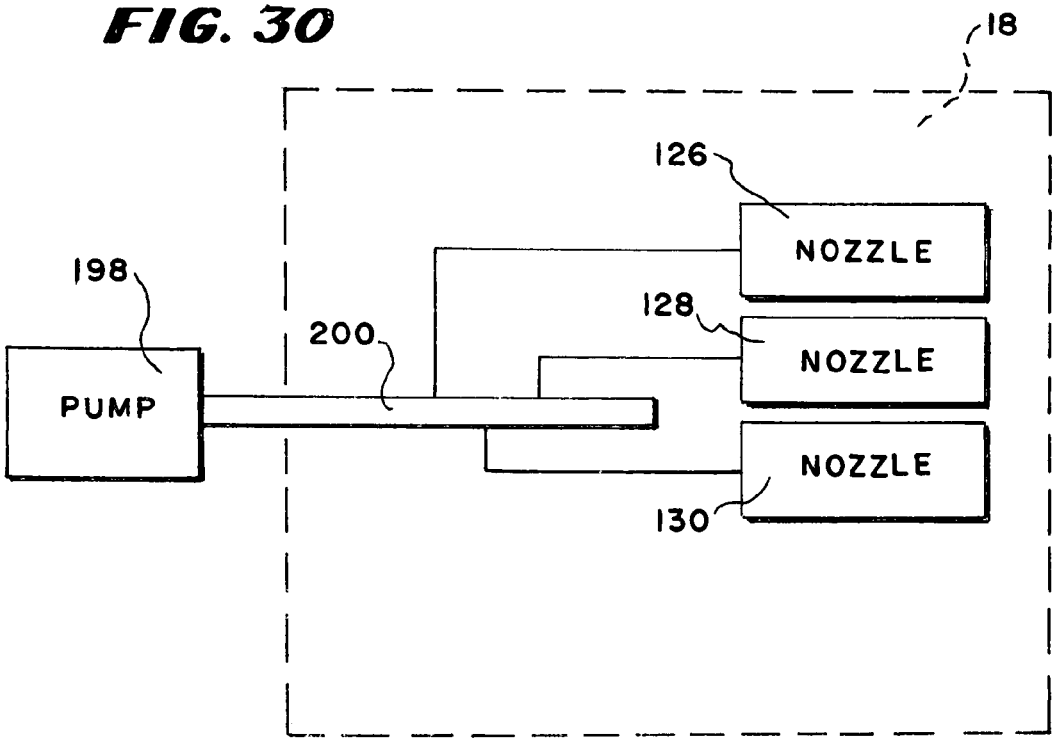
FIG. 30 is a schematic diagram of the water nozzle assembly for the embodiment of FIG. 11.

In FIG. 30, there is shown a schematic diagram of the fluid system for the fourth station shown at 18 having a pump 198, a main conduit 200 and nozzles 126, 128 and 130. In this station, the nozzles are adjustable in flow rate one foot from the nozzle of between zero and 11.6 feet per second. The pump is a one horsepower pump and the nozzle diameters are generally 1.5 inches. The nozzles are positioned 30 inches from the floor and 12 inches in front of the first step 120 (FIG. 11), 36 inches from the floor and 8 inches in front of the second step 122 (FIG. 11) and 40 inches from the floor and 8 inches in front of the third step 122 (FIG. 11).

Figure 31:
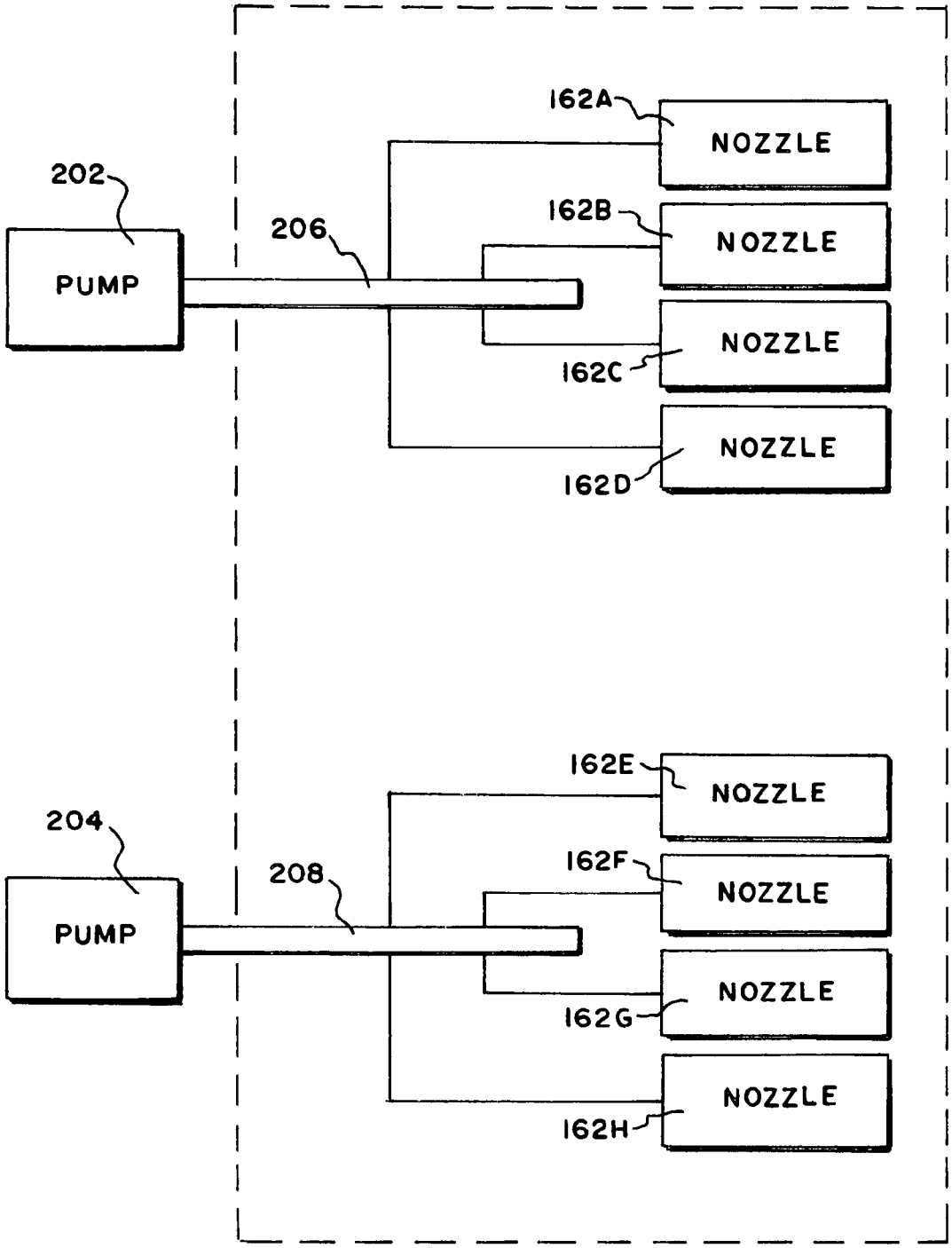
FIG. 31 is a schematic diagram of the water nozzle assembly for the embodiment of FIG. 15

In FIG. 31, there is shown a schematic flow diagram of station seven having a first pump 202 pumping water into a main conduit 206 to feed the fluid to four nozzles 162A-162D and a second pump 204 applying fluid to the main conduit 208 to supply fluid to four nozzles 162E-162H. The pump 202 is a three horsepower pump and the pump 204 is a five horsepower pump. The flow of liquid in the circular area or loop 158 (FIG. 16) is clockwise. The nozzle 162D is 44 inches from the floor and 14 inches from the entrance 156, the nozzle 162C is 40 inches from the floor and 42 inches from the nozzle 162D, the nozzle 162B is 32 inches from the floor and 42 inches from the nozzle 162C and the nozzle 162A on the straight section 164 is 32 inches from the floor and approximately three inches from the corner of the side wall 148. The circular section 160 (FIG. 16) has flow in the counterclockwise direction. The nozzle 162H is three inches from the corner extending from the straight wall 164, the nozzle 162G is 12 inches from the floor and 60 inches from the corner, the nozzle 162F is 18 inches from the floor and 38 inches from the nozzle 162G and the nozzle 162E is 24 inches from the floor and 38 inches from the nozzle 162F. The nozzle 162D has a flow of between 4.2 feet per second and 7.6 feet per second when measured at a distance of one foot from the nozzle and a flow rate of 3.7 feet per second to 6.1 feet per second when measured two feet from the nozzle.

The nozzle 162C has a flow rate of between four feet per second and 7.2 feet per second when measured one foot from the outlet of the nozzle and a flow rate of 3.6 feet per second and five feet per second when measured two feet from the outlet of the nozzle. The nozzle 162B has a flow rate of between three feet per second and six feet per second when measured one foot from the outlet of the nozzle and a flow rate of 2.5 feet per second and 4.3 feet per second when measured two feet from the outlet of nozzle. The nozzle 162A has a flow rate of between one foot per second and 8.8 feet per second when measured one foot from the outlet of the nozzle and a flow rate of between one foot per second and 5.7 feet per second when measured two feet from the outlet of the nozzle. The nozzle 162H has a flow rate of between 3.4 feet per second and 10.2 feet per second when measured one foot from the outlet of the nozzle and a flow rate of between 2.8 feet and 7.4 feet when measured two feet from the outlet of the nozzle. The nozzle 162G has a flow rate of between 3.6 feet per second and 7.1 feet per second when measured one foot from the outlet of the nozzle and between 2.6 feet per second and 4.3 feet per second when measured two feet from the outlet of the nozzle. The nozzle 162F has a flow rate of between 3.9 feet per second and 8.6 feet per second when measured one foot from the outlet of the nozzle and a flow rate of between two and 6.7 feet per second when measured two feet from the outlet of the nozzle. The nozzle 162E has a flow rate of between 3.9 feet per second and 8.6 feet per second when measured one foot from the outlet of the nozzle and a flow rate of between two and 6.7 feet per second when measured two feet from the outlet the nozzle. The clockwise flow in the chamber 160 at constant height approximately one foot six inches from the wall is 3.2 feet per second at the three o'clock position, 0.3 at the six o'clock position, 1.8 at the nine o'clock position and 1.8 at the twelve o'clock position. Similarly at the same height and distance from the wall, the counterclockwise flow rate in the chamber 158 is 3.4 feet per second at the three o'clock position, 0.7 feet per second at the six o'clock position, 1.7 feet per second at the nine o'clock position and 1.8 feet per second at the twelve o'clock position.

Figure 32:
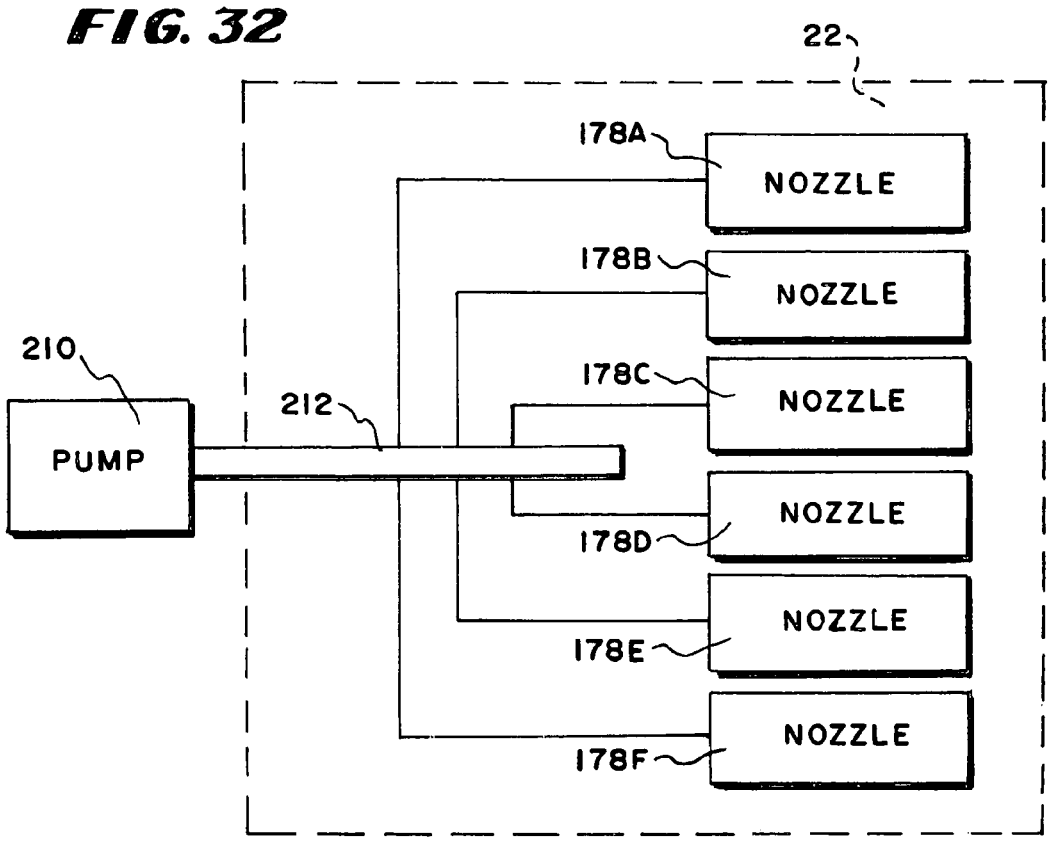
FIG. 32 is a schematic diagram of the water nozzle assembly for the embodiment of FIG. 20.

In FIG. 32, there is shown a schematic flow diagram of the water flow for the eighth station 22 having a pump 210, a main conduit 212 and nozzles 178A-178F. The pump 210 is a one horsepower pump pumping fluid into the main conduit 212 to pressurize the nozzles. Each of the nozzles has a flow rate adjustable between 0 and 5 feet per second when the flow rates are measured a distance of one foot from the outlet of the nozzle. The nozzle 178A is at the top center 28 inches from the floor along the center line of the station. The nozzle 178C is on the right bottom three inches into the elliptical void and six inches from the floor. The nozzle 178D is at the left bottom three inches into the elliptical void and six inches from the floor. The nozzle 1 78F is at the bottom center of the station six inches outside of the elliptical void. The nozzle 178B is at the right middle 12 inches into the elliptical void and 14 inches from the floor. The nozzle 178E is at the left middle twelve inches into the elliptical void and 14 inches from the floor.

Figure 33:
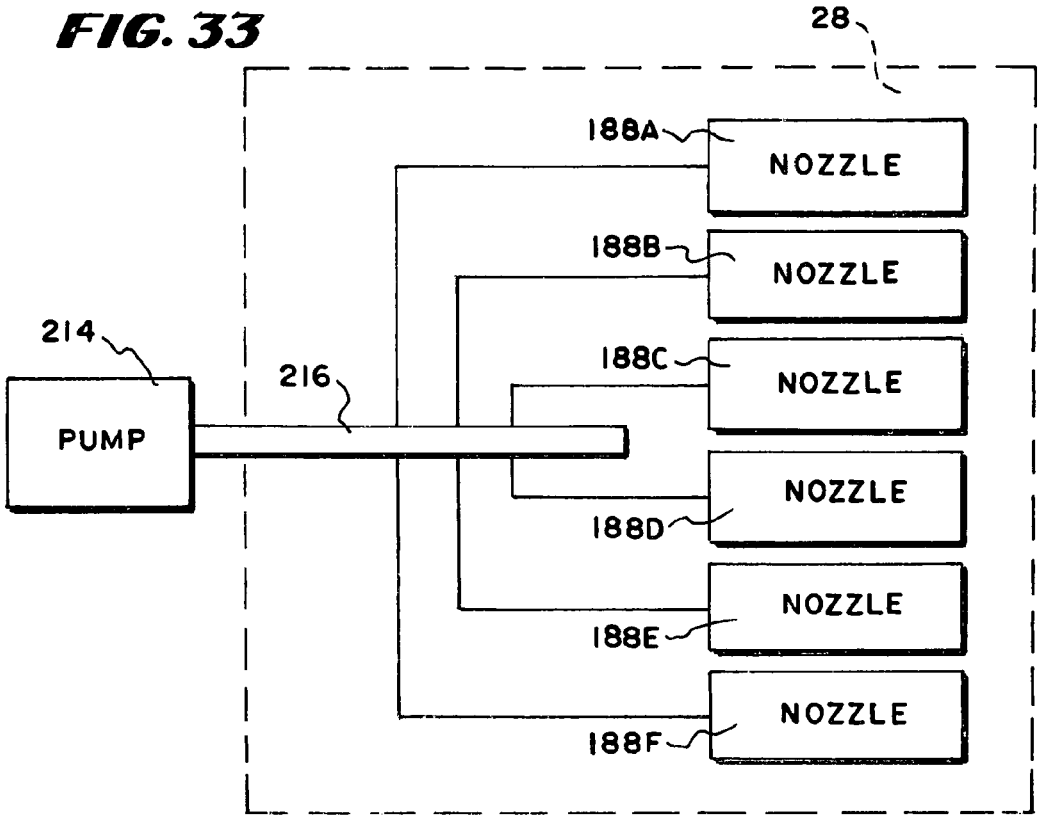
FIG. 33 is a schematic diagram of the water nozzle assembly for the embodiment of FIG. 24.

In FIG. 33, there is shown a schematic diagram of the flow for station nine shown generally at 28 having a pump 214, a main conduit 216 and six nozzles 188A-188F. Each of the nozzles has a flow reading at one foot from its outlet adjustable between zero and six feet per second. The pump 214 is a 2.5 horsepower pump and the outlets have a diameter of 1.5 inches. The nozzles are all 34 inches from the floor symmetrically spaced around the perimeter of the station approximately 15 inches from each other.

In operation, the therapist evaluates the patient on dry land using standard tests such as the adduction drop test, extension drop test, trunk rotation tests, straight leg raise test and the like to determine deficiencies in movement and positioning of the body parts. These tests are readily identified in standard text material and on line such as in the web site of the Postural Restoration Institute. They are known to physical therapists.

The therapy pool is used to provide resistance through water movement directed at parts of the body to reduce neuromotor and abnormal muscle tone secondary to patterns that develop because of compensatory activity that takes place on dry land secondary to overused back extensors, hip flexors, and musculature that promotes non diaphragmatic breathing. This particular issue of torque and torsion that is produced because of the asymmetries of the body's viscera, lungs, and neuromotor activity requires isolated activity to reduce muscles that are overused to compensate for these patterns that have developed over time.

There are nine stations in this pool that provide neuromuscular isolation with feed forward activation. Feed forward activation is a description of a process that allows muscles to learn how to work without making mistakes or without performing the activity incorrectly and then giving feedback after the activity was done correctly. This is different from biofeedback, which tells you how you perform the process after you carried out the process or attempted to carry out the process with selected muscles by providing an error signal that signals the need to correct the process. If you carry out the process incorrectly, you further develop that abnormal pattern of muscle tone. With this exercise pool's directed sequential movement, one can be placed in a position where those patterns of overused muscles can be inhibited and reduced by placing the patient in a position and working him or her in a direction that is opposite of what he or she normally would do on dry land. Therefore, through feed forward activation, one can pre-activate musculature that helps an individual regain composure, control, and consistent, properly timed muscle activity that cannot be performed on dry land because of the gravitational issues, the possible orthopedic or neuromuscular structural issues that one is contending with, and the adaptation to equipment that focuses only on one muscle group versus a number of muscle groups and patterns that develop or generate bad habits.

This pool allows a person to become more buoyant and therefore, allows that same individual to carry out proprioceptive neuromuscular patterns of resistance that will allow them to strengthen without becoming overly fatigued and without compensating with bad patterns or dry land bad anti-gravitational patterns that lead to low back strain, scoliosis, headaches, forward head posture, and bad breathing patterns.

This pool also works an individual in all three planes and facilitates not only tri-planar activity, but through a process to reduce the more common patterns of neuromotor dysfunction so often seen in the human body. In other words, the left abdominal wall can be strengthened at the same time with the left hamstrings and adductors and the right lower trapezius muscles. That is an example of how one can integrate these sites of muscle weaknesses to work more cooperatively together in a concomitant fashion without overloading an individual and making that same individual therefore address a task that results in only one muscle group being overworked and not a series of groups of muscles that should work at the same time to reduce strain, sprain, and inflammation of these particular overused and over-trained muscles. The therapy pool also improves balance by decreasing compensatory muscle tone and increasing symmetry of the body through movement of water that can be varied according to the patient's vestibular strength and neuro-vestibular control.

Refraction is also offered by this pool in that it is evident when looking from an air medium to a water medium, it will provide a therapeutic effect that will help decrease depth perception and make a person feel more like they are standing closer to the ground for good visualization of single leg dynamic activities that cannot be performed in a general or normal pool because of lack of directed water flow at selected muscles with selected patterns of neuromuscular dysfunction. The visual feedback from this refraction will have a direct impact on the patient's ability to relax as they carry out this challenging but not over-challenging directed water flow. There are a number of nozzles directed in different positions on the body at each one of these stations for purposes that will mimic activities that are performed on dry land with the postural restoration process.

For the postoperative patient, this pool will be very useful in therapeutically introducing refraction, feed forward activation on neuromuscular patterns that are hypertonic, and it will also allow these people to improve their balance through reducing this compensatory muscle tone and asymmetry of their body by again giving them gentle reminders on what muscles to turn on so they can reciprocally inhibit those muscles that they cannot turn off on dry land.

This pool's concept and organization basically influences the individual's body movement through directed water movement patterns to offset compensatory movement patterns that exist in predictable tri-planar organization and through polyarticular muscular patterns of neuromotor dysfunction.

It can therefore be understood that the method and apparatus of this invention has several advantages, such as for example: (1) it permits neuromuscular repositioning and retraining in all three dimensions (three planes) instead of only one dimension (in only one plane) without neuromotor compensation; (2) it provides forward feedback rather than biofeedback as a training mechanism; and (3) it is economical when used on a large scale since the same equipment can provided tailored therapy to many different patients Although a preferred embodiment has been described with some particularity, many modifications and variations in the preferred embodiment are possible in the light of the above teachings. Accordingly, it is to be understood that, within the scope of the appended claims, the invention may be practiced other than as specifically described.

What is claimed is:

1. A method of physical therapy comprising the steps of:

providing a pool therapy fixture having nozzles;

diagnosing faulty body position of a patient;

training the patient to reposition the patient's body parts to improve the faulty body position using feed forward training exercises;

said step of training the patient to reposition the patient's body parts to improve the faulty body position using feed forward training exercises including the steps of applying selected forces from multiple directions in a programmed manner to reposition the patient's body parts from an undesirable position to a more desirable position with at least one said pool therapy fixture to provide neuromuscular training; and moving limbs of a patient's body and the patient's body against the selected forces wherein said forces are applied by one or more resistances to the body to programmed fluidic forces and facilitation of movement of one or more body parts to the programmed fluidic forces.

2. A method in accordance with claim 1 in which the patient's body is in a pool of water whereby reduced patient weight is provided.

3. A method in accordance with claim 1 in which a patient moves first in a direction against the flow of fluid flowing principally from one side of a sagittal plane and then principally from the other side of the sagittal plane.

4. A method in accordance with claim 1 in which said fluidic forces result from water being pumped through one or more said nozzles.

5. A method in accordance with claim 4 in which fluid force and direction of the force can be controlled individually for one or more of said nozzles.

6. The method of claim 1 wherein the step of moving limbs of a body and the body against the selected forces comprises the step of positioning body parts based on proprioception.

7. The method of claim 1 wherein the step of training the patient to reposition the patient's body parts to improve the faulty body position using feed forward training exercises comprises the steps of firstly applying force from said pool therapy fixture at an angle to one side of the patient's body at first locations on the patient's body while the patient moves against clockwise flow of water in a first loop of a figure eight pattern and secondly applying force from the pool therapy fixture at an angle to another side of the patient's body at second locations on the patient's body while the patient moves against counterclockwise flow of water in a second loop of the figure eight pattern.

8. The method of claim 1 wherein the step of training the patient to reposition the patient's body parts to improve the faulty body position using feed forward training exercises comprises the steps of applying fluid force from said pool therapy fixture against leg abduction movements while the patient is sitting and applying fluid force from the pool therapy fixture against leg adduction movements while the patient is sitting.

9. The method of claim 1 wherein the step of training the patient to reposition the patient's body parts to improve the faulty body position using feed forward training exercises comprises the steps of applying fluid force from said pool therapy fixture to promote at least one of femoral acetabular internal rotation and external femoral acetabular rotation while the patient is sitting.

10. The method of claim 1 wherein the step of training the patient to reposition the patient's body parts to improve the faulty body position using feed forward training exercises comprises the steps of applying fluid force to either side of the patient's body alone or in combination with fluid force acting on the front or back side of the patient.

11. The method of claim 1 wherein the step of training the patient to reposition the patient's body parts to improve the faulty body position using feed forward training exercises comprises the steps of applying fluid force resistance to either side of the patient's body while the patient walks up stairs backwards against fluid force.

12. The method of claim 1 wherein the step of training the patient to reposition the patient's body parts to improve the faulty body position using feed forward training exercises comprises the steps of applying fluid force resistance to a patient first principally from one side of a sagittal plane and then from the other side of the sagittal plane as the patient moves to different locations in a pool.

13. The method of claim 1 wherein the step of training the patient to reposition the patient's body parts to improve the faulty body position using feed forward training exercises comprises the steps of applying fluid force resistance to muscles of a patient at one location in a pool from one direction and to muscles of the patient from another direction when the patient is at another location in the pool.

14. The method of claim 1 wherein the step of training the patient to reposition the patient's body parts to improve the faulty body position using feed forward training exercises comprises the steps of applying fluid force resistance to a patient as the patient moves between two different sections of a pool with varying flow patterns.

15. The method of claim 1 wherein the step of training the patient to reposition the patient's body parts to improve the faulty body position using feed forward training exercises comprises the steps of applying fluid force resistance to a patient while the patient remains in one section of a pool with varying flow patterns and varying applied fluid forces.

16. The method of claim 1 wherein the step of training the patient to reposition the patient's body parts to improve the faulty body position using feed forward training exercises comprises the steps of applying fluid force resistance to a patient in one of a rotational or straight pattern while the patient stands in a partially cylindrical shaped pool section.

* * * * *